US010482701B2

(12) United States Patent
Yanagiuchi et al.

(10) Patent No.: US 10,482,701 B2
(45) Date of Patent: Nov. 19, 2019

(54) SHEET HANDLING APPARATUS AND SHEET HANDLING MACHINE

(71) Applicant: GLORY LTD., Himeji-shi, Hyogo (JP)

(72) Inventors: Hidetomo Yanagiuchi, Himeji (JP); Hisashi Ishitobi, Himeji (JP); Toshiyuki Kuroda, Himeji (JP); Masaaki Fukazawa, Himeji (JP)

(73) Assignee: GLORY LTD., Himeji-Shi, Hyogo (JP)

( * ) Notice: Subject to any disclaimer, the term of this patent is extended or adjusted under 35 U.S.C. 154(b) by 0 days.

(21) Appl. No.: 15/919,555

(22) Filed: Mar. 13, 2018

(65) Prior Publication Data

US 2018/0261033 A1 Sep. 13, 2018

(30) Foreign Application Priority Data

Mar. 13, 2017 (JP) ..... 2017-047165

(51) Int. Cl.

| | |
|---|---|
| ***G07D 11/18*** | (2019.01) |
| ***G07D 11/13*** | (2019.01) |
| ***G07D 11/17*** | (2019.01) |
| ***B65H 9/20*** | (2006.01) |
| ***B65H 7/02*** | (2006.01) |
| ***B65H 5/02*** | (2006.01) |
| ***G07D 11/14*** | (2019.01) |

(Continued)

(52) U.S. Cl.

CPC ..... *G07D 11/18* (2019.01); *B65H 3/063* (2013.01); *B65H 3/0653* (2013.01); *B65H 5/006* (2013.01); *B65H 5/023* (2013.01); *B65H 7/02* (2013.01); *B65H 9/20* (2013.01); *B65H 29/12* (2013.01); *B65H 31/3027* (2013.01); *B65H 31/3045* (2013.01); *G07D 11/13* (2019.01); *G07D 11/14* (2019.01); *G07D 11/16* (2019.01); *G07D 11/17* (2019.01); *B65H 2301/42262* (2013.01); *B65H 2404/741* (2013.01); *B65H 2511/521* (2013.01); *B65H 2515/60* (2013.01); *B65H 2553/42* (2013.01); *B65H 2701/1912* (2013.01); *G07D 7/12* (2013.01); *G07D 2207/00* (2013.01); *G07D 2211/00* (2013.01)

(58) Field of Classification Search

CPC .... B65G 15/14; G07D 11/18; G07D 2211/00; G07D 2207/00; B65H 2404/741

USPC ..... 198/626.1

See application file for complete search history.

(56) References Cited

U.S. PATENT DOCUMENTS 7,722,041 B2 * 5/2010 Honda ..... B65H 31/10 270/58.19

FOREIGN PATENT DOCUMENTS

| | | |
|---|---|---|
| JP | 2005-338990 A | 12/2005 |
| JP | 2016-169076 A | 9/2016 |

(Continued)

OTHER PUBLICATIONS

European Search Report (Application No. 18160457.0) (7 pages—dated Jul. 26, 2018).

*Primary Examiner* — Gene O Crawford
*Assistant Examiner* — Lester Rushin, III
(74) *Attorney, Agent, or Firm* — Renner, Kenner, Greive, Bobak, Taylor & Weber

(57) ABSTRACT

A sheet handling apparatus (e.g., banknote insertion/discharge mechanism 20) includes a transport unit (e.g., first transport unit 30) configured to transport a sheet (e.g., banknote) in a first transport path 30*a*; and driving units 36*m* and 38*m* configured to move, along the width direction of (Continued)

the first transport path 30*a*, at least portions of guiding members 36 and 38 forming edges of the first transport path 30*a*.

12 Claims, 11 Drawing Sheets

(51) Int. Cl.

| | |
|---|---|
| ***B65H 29/12*** | (2006.01) |
| ***B65H 5/00*** | (2006.01) |
| ***G07D 11/16*** | (2019.01) |
| ***B65H 31/30*** | (2006.01) |
| ***B65H 3/06*** | (2006.01) |
| *G07D 7/12* | (2016.01) |

(56) References Cited

FOREIGN PATENT DOCUMENTS

| | | | | |
|---|---|---|---|---|
| WO | WO-2015072340 A1 * | 5/2010 | ..... | B65H 29/46 |
| WO | WO 2015/072340 A1 | 5/2015 | | |

* cited by examiner

SHEET HANDLING APPARATUS AND SHEET HANDLING MACHINE

CROSS-REFERENCE TO RELATED APPLICATION

This application claims priority to Japanese Patent Application No. 2017-047165 filed on Mar. 13, 2017, the entire contents of which are incorporated herein by reference.

BACKGROUND OF THE INVENTION

1. Field of the Invention

The present invention relates to a sheet handling apparatus that performs handling of sheets such as banknotes, and a sheet handling machine including the sheet handling apparatus.

2. Description of the Related Art

As a banknote depositing/dispensing machine used in financial facilities, a banknote depositing/dispensing machine disclosed in Japanese Laid-Open Patent Application No. 2016-169076 (JP2016-169076A) has been known. In such a conventional banknote depositing/dispensing machine, banknotes, which have been collectively inserted in a batch form into a banknote inlet by a customer, are taken in into a housing of the machine and are fed one by one by a banknote feeding unit toward a transport unit. The banknotes fed to the transport unit are transported in the housing by the transport unit, and a recognition unit performs recognition of denomination, authenticity, fitness/unfitness for each banknote. The banknotes recognized by the recognition unit are temporarily stored in a temporary storage unit. When deposition of the banknotes has been confirmed, the banknotes temporarily stored in the temporary storage unit are sent one by one to a storage unit and stored in the storage unit. The banknotes collectively inserted in a batch form into the banknote inlet are gripped between paired upper and lower belts. The paired upper and lower belts are moved with the banknotes in a batch form being gripped therebetween, whereby the banknotes in a batch form are inserted into the housing from the outside along a transport path.

SUMMARY OF INVENTION

In the conventional banknote depositing/dispensing machine as disclosed in Japanese Laid-Open Patent Application No. 2016-169076 (JP2016-169076A), when banknotes are inserted into the banknote inlet, if the banknotes are positioned near either one of right and left guiding members forming side walls at both edges of the transport path so that the side walls guide the banknotes along the transport path, the banknotes transported along the transport path may be caught by the guiding members, which may cause a trouble such as transportation failure.

The present invention is made in view of such a problem, and an object of the present invention is to provide a sheet handling apparatus and a sheet handling machine which can prevent occurrence of transportation failure when sheets transported by a transport unit.

A sheet handling apparatus of the present invention includes a transport unit configured to transport a sheet in a transport direction of a first transport path; and a driving unit configured to move, along a width direction of the first transport path, at least a portion of a guiding member forming a side wall at an edge of the first transport path.

In the sheet handling apparatus of the present invention, a pair of the guiding members may be provided at both the edges of the first transport path, and the driving unit may be able to move the guiding members in directions away from each other and in directions approaching each other.

In the sheet handling apparatus of the present invention, the driving unit may move the guiding members by the same movement amount.

In the sheet handling apparatus of the present invention, the transport unit may include paired belts arranged so as to be spaced from each other, and the belts are moved with sheets in a batch form being gripped therebetween, to transport the sheets in a batch form.

In the sheet handling apparatus of the present invention, the driving unit may move at least a portion of the guiding member along the width direction of the first transport path such that a width of the first transport path in a case where a sheet is transported by the transport unit is greater than a width of the first transport path in a case where a sheet is not transported by the transport unit.

In this case, a first sheet detection unit configured to detect a sheet may be provided near an inlet of the first transport path, and when a sheet is detected by the first sheet detection unit, at least a portion of the guiding member may be moved by the driving unit along the width direction of the first transport path such that the width of the first transport path is increased.

In addition, when a sheet is detected by the first sheet detection unit, transportation of the sheet by the transport unit may be started.

In the sheet handling apparatus of the present invention, the transport unit may include a second transport path connected to the first transport path, and the driving unit may move at least a portion of the guiding member along the width direction of the first transport path such that a width of one of the first transport path and the second transport path, which is located at a downstream transport path, is greater than a width of the other transport path which is located at an upstream transport path.

In this case, in the transport unit, the second transport path may be disposed upstream of the first transport path, a second sheet detection unit configured to detect a sheet may be provided at an inlet of the second transport path, and when a sheet is detected by the second sheet detection unit, at least a portion of the guiding member may be moved by the driving unit along the width direction of the first transport path such that the width of the first transport path is greater than the width of the second transport path.

In addition, when a sheet is detected by the second sheet detection unit, transportation of the sheet by the transport unit may be started.

A sheet handling machine of the present invention includes a housing; and the sheet handling apparatus according described above, and the sheet handling apparatus is provided on a receptacle through which a plurality of sheets is collectively inserted into the housing from the outside, and a plurality of sheets is collectively discharged from the housing to the outside.

In the sheet handling machine of the present invention, when a plurality of sheets is collectively inserted into the housing from the outside, at least a portion of the guiding member may be moved by the driving unit such that a width of the first transport path is increased as compared with a stand-by state.

In the sheet handling machine of the present invention, a transport mechanism configured to transport sheets may be provided inside the housing, the transport mechanism being directly or indirectly connected to the transport unit, and the transport mechanism may include a shifting mechanism configured to shift, in a width direction, the sheets being transported by the transport mechanism.

In the sheet handling apparatus of the present invention, the sheet being transported by the transport unit may pass through the transport path between the both guiding members.

DESCRIPTION OF THE PREFERRED EMBODIMENTS

Figure 1:
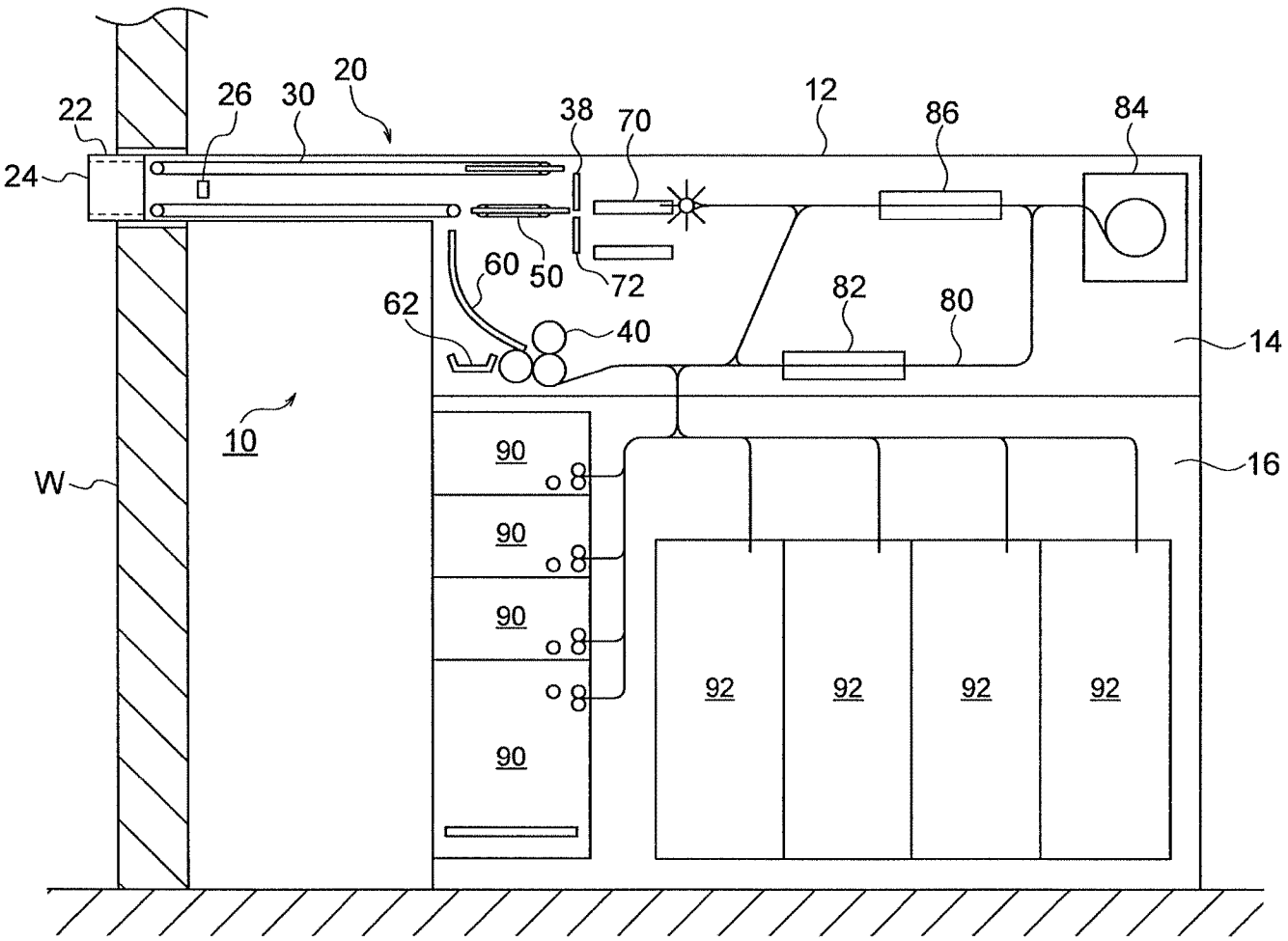
FIG. 1 is a schematic diagram illustrating an internal structure of a banknote handling machine according to an embodiment of the present invention.

Hereinafter, an embodiment of the present invention will be described with reference to the drawings. FIG. 1 to FIG. 14 illustrate a banknote handling machine according to the present embodiment and a banknote handling method performed by using the banknote handling machine. In FIG. 2 to FIG. 14, a batch of banknotes handled by the banknote handling machine according to the present embodiment is represented by a reference character P. In the following description, a plurality of banknotes in a batch form is also referred to as a batch of banknotes.

The banknote handling machine 10 according to the present embodiment can perform various types of handling such as depositing and dispensing of banknotes. As shown in FIG. 1, the banknote handling machine 10 according to the present embodiment consists of two units, i.e., an upper unit 14 and a lower unit 16. The banknote handling machine 10 includes: a housing 12 having a substantially rectangular-parallelepiped shape; and a banknote insertion/discharge mechanism 20 (sheet handling apparatus) for inserting a batch of banknotes into the housing 12 from the outside, and discharging a batch of banknotes from the housing 12 to the outside. A side, of the housing 12, on the left side in FIG. 1 corresponds to a front side of the housing 12, and a rightward direction in FIG. 1 corresponds to a depth direction of the housing 12. Therefore, the banknote insertion/discharge mechanism 20 is disposed on the front side of the housing 12.

A transport unit 80 (transport mechanism) that transports banknotes one by one is provided in the housing 12 of the banknote handling machine 10. The banknote insertion/discharge mechanism 20 includes a feeding unit 40 for feeding banknotes one by one from a batch of banknotes inserted into the banknote insertion/discharge mechanism 20 from the outside of the housing 12. The banknotes fed by the feeding unit 40 are transported by the transport unit 80. The transport unit 80 is provided with a recognition unit 82. This recognition unit 82 performs recognition of denominations, authenticity, fitness/unfitness, face/back, old/new version, transport state for the banknotes transported by the transport unit 80. More specifically, the recognition unit 82 includes an image sensor, and an image of each banknote is taken by this image sensor. The recognition unit 82 performs recognition of denomination, authenticity, fitness/unfitness, face/back, old/new version, transport state for each banknote on the basis of the image of the banknote taken by the image sensor. In the recognition unit 82, on the basis of the image of each banknote taken by the image sensor, information regarding a serial number of the banknote is obtained.

A temporary storage unit 84 is connected to the transport unit 80. The banknotes that have been fed from the feeding unit 40 to the transport unit 80 and recognized by the recognition unit 82 are transported to the temporary storage unit 84 by the transport unit 80, and temporarily stored in the temporary storage unit 84. The transport unit 80 is provided with a shifting unit 86. By the shifting unit 86, the positions of the banknotes transported by the transport unit 80 are shifted along a direction orthogonal to the transport direction of the transport unit 80. The direction orthogonal to the transport direction of the transport unit 80 is identical to a width direction of the banknotes transported by the transport unit 80 and a width direction of the transport path. By the shifting unit 86, the banknotes being transported by the transport unit 80 can be shifted to, for example, a center position of the transport path in the width direction of a transport path of the transport unit 80.

A dispensing temporary storage unit 70 is connected to the transport unit 80. When banknote dispensing is performed, banknotes sent from banknote storages 92 (described later) to the transport unit 80 are stacked in a layered state in the dispensing temporary storage unit 70 after being recognized by the recognition unit 82. When all the banknotes to be dispensed are stacked in the dispensing temporary storage unit 70, the banknotes in a batch form are sent from the dispensing temporary storage unit 70 to the banknote insertion/discharge mechanism 20, and are discharged to the outside of the housing 12 by the banknote insertion/discharge mechanism 20. The operation of discharging a batch of banknotes by the banknote insertion/discharge mechanism 20 will be described later in detail.

In the present embodiment, the banknote insertion/discharge mechanism 20, the recognition unit 82, the temporary storage unit 84, the shifting unit 86, and the dispensing temporary storage unit 70 are provided in the upper unit 14.

Meanwhile, as shown in FIG. 1, a plurality of storage/feeding units 90 is provided in the lower unit 16 of the banknote handling machine 10, and each of the storage/feeding units 90 is connected to the transport unit 80. Each storage/feeding unit 90 stores therein banknotes, in a layered state, transported from the transport unit 80. The banknotes stored in each storage/feeding unit 90 can be fed one by one to the transport unit 80 by a banknote feeding mechanism provided in the storage/feeding unit 90. In the lower unit 16 of the banknote handling machine 10, a plurality of banknote storages 92 is provided. Each of the banknote storages 92 is arranged in parallel to each other, and is connected to the transport unit 80. Each banknote storage 92 stores therein banknotes, in a layered state, transported from the transport unit 80. The banknotes stored in each banknote storage 92 can be fed one by one to the transport unit 80 by a banknote feeding mechanism provided in the banknote storage 92. In the respective banknote storages 92, banknotes are stored according to denominations. In this configuration, on the basis of the result of recognition for banknotes by the recognition unit 82, the banknotes temporarily stored in the temporary storage unit 84 are sent from the temporary storage unit 84 to the transport unit 80, and are transported by the transport unit 80 through the shifting unit 86 to the banknote storages 92 according to the denominations thereof.

Next, the configuration of the banknote insertion/discharge mechanism 20 in the banknote handling machine 10 will be described in detail with reference to FIG. 2 to FIG. 7.

Figure 2:
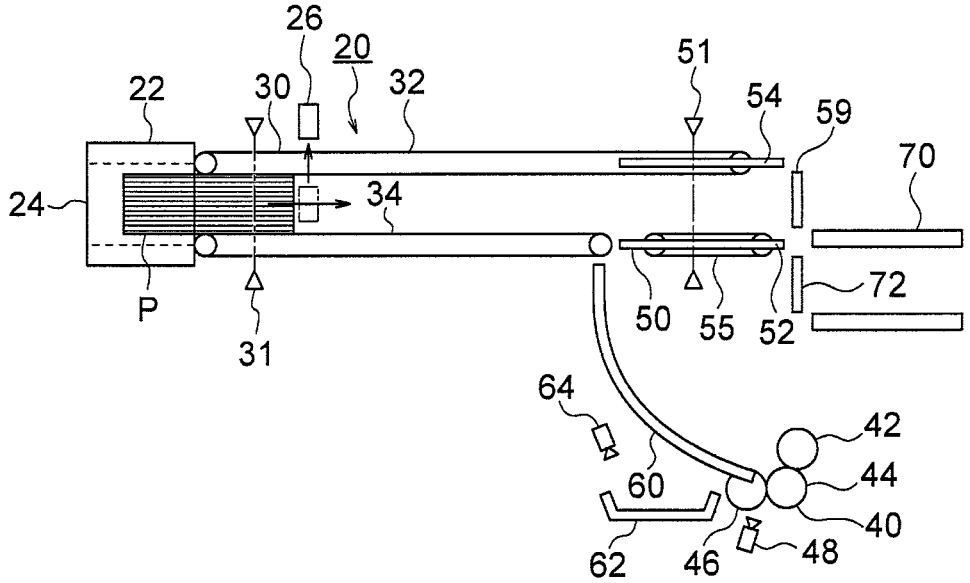
FIG. 2 is a side view of a structure of a banknote insertion/discharge mechanism in the banknote handling machine shown in FIG. 1, illustrating a state where a batch of banknotes is inserted in an opening.

As shown in FIG. 2 and the like, the banknote insertion/discharge mechanism 20 includes: a first transport unit 30 that horizontally transports a batch of banknotes; the feeding unit 40 that feeds banknotes one by one; and a second transport unit 50 that transports a batch of banknotes transported by the first transport unit 30 to the feeding unit 40.

Figure 5:
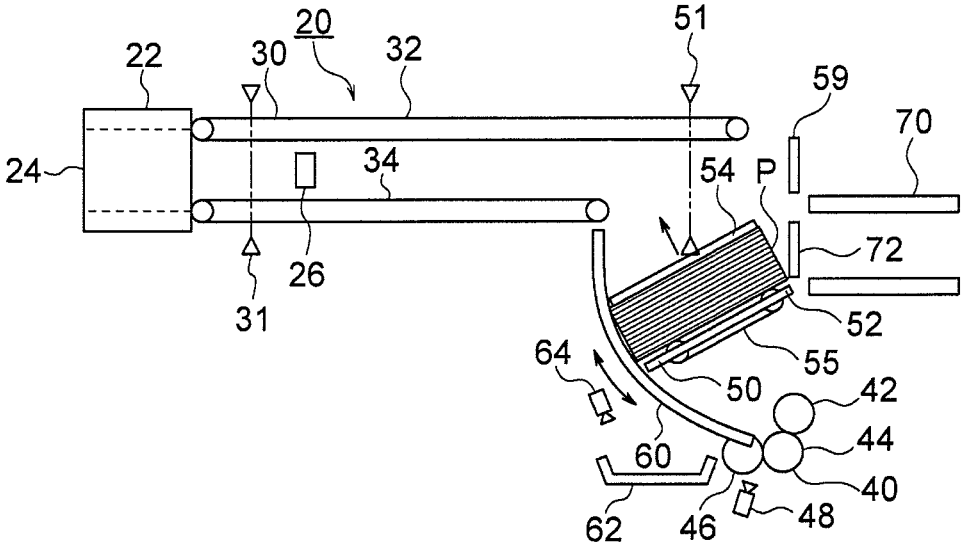
FIG. 5 is a side view illustrating a state where a batch of banknotes is transported by the second transport unit in the banknote insertion/discharge mechanism shown in FIG. 2.

Further, as shown in FIG. 5, the second transport unit 50 causes a batch of banknotes to be inclined from the horizontal state so as to form an angle with respect to the horizontal surface. Hereinafter, the respective components of the banknote insertion/discharge mechanism 20 will be described in detail.

As shown in FIG. 2 and the like, the first transport unit 30 includes paired endless belts 32 and 34 provided so as to be spaced from each other in the vertical direction. The endless belts 32 and 34 extend in the horizontal direction. A transport area in which a batch of banknotes is horizontally transported is formed between the paired endless belts 32 and 34. Further, as described later, of the paired endless belts 32 and 34, the upper endless belt 32 is movable in a direction approaching the lower endless belt 34 and in a direction away from the lower endless belt 34. Thus, when a batch of banknotes is placed in the transport area formed between the paired endless belts 32 and 34, the upper endless belt 32 moves in the direction approaching the lower endless belt 34, whereby the batch of banknotes is gripped between the paired endless belts 32 and 34. The endless belts 32 and 34 circulate with the batch of banknotes being gripped therebetween, whereby the batch of banknotes is transported. Further, as shown in FIG. 2 and the like, a far-side end portion of the upper endless belt 32 in the depth direction of the housing 12 is located at a position farther in the housing 12 than a far-side end portion of the lower endless belt 34 (i.e., a position on the right side in FIG. 2 or the like).

As shown in FIG. 2 and the like, at an end portion of the first transport unit 30 on the front side of the housing 12 (i.e., an end portion thereof on the left side in FIG. 2 and the like), an receptacle 22 is provided through which a batch of banknotes is inserted into the housing 12 from the outside, and a batch of banknotes is discharged from the housing 12 to the outside. Inside the receptacle 22, a hollow area that allows a batch of banknotes to pass therethrough is formed. An opening 24 that allows access to the hollow area is formed at an end portion of the receptacle 22 on the front side of the housing 12. The opening 24 of the receptacle 22 allows an operator to insert a batch of banknotes into the hollow area inside the receptacle 22, and take out a batch of banknotes from the hollow area to the outside of the housing 12. A catch plate 26 that catches a batch of banknotes inserted in the hollow area inside the receptacle 22 is formed near end portions of the paired endless belts 32 and 34 on the receptacle 22 side. The catch plate 26 is movable between: an advanced position between the paired endless belts 32 and 34 as represented by a two-dot chain line in FIG. 2; and a retracted position to which the catch plate 26 is retracted from the advanced position between the paired endless belts 32 and 34 as represented by a solid line in FIG. 2. The retracted position is outside between the paired endless belts 32 and 34. When the catch plate 26 is located at the advanced position, a batch of banknotes inserted in the hollow area inside the receptacle 22 through the opening 24 by the operator is caught by the catch plate 26 and prevented from further moving into the first transport unit 30. On the other hand, when the catch plate 26 moves from the advanced position to the retracted position, the batch of banknotes inserted in the hollow area inside the receptacle 22 is transported into the housing 12 by the first transport unit 30.

As shown in FIG. 2 and the like, a first detection sensor 31 is provided near the receptacle 22. The first detection sensor 31 detects a batch of banknotes inserted in the hollow area inside the receptacle 22 through the opening 24 by the operator. The first detection sensor 31 is composed of, for example, an optical sensor having a light-emitting element and a light-receiving element that are arranged across the space between the paired endless belts 32 and 34. In the first detection sensor 31, when light emitted from the light-emitting element is not received by the light-receiving element because being blocked by the batch of banknotes inserted in the hollow area inside the receptacle 22 through the opening 24, the first detection sensor 31 detects that the batch of banknotes is inserted in the hollow area inside the receptacle 22.

In a case where the banknote handling machine 10 according to the present embodiment is used as, for example, an ATM (automated teller machine) in a financial facility such as a bank, an area where the banknote handling machine 10 is placed is isolated by a wall (represented by a reference character W in FIG. 1) of the financial facility from an area where customers operate the ATM (i.e., an area to the left of the wall in FIG. 1). In this case, the first transport unit 30 is arranged so as to penetrate the wall of the financial facility, and the receptacle 22 is placed in the area where customers operate the ATM. In the case where the first transport unit 30 is arranged so as to penetrate the wall of the financial facility, the distance along which a batch of banknotes is transported by the first transport unit 30 needs to be relatively long.

As shown in FIG. 2 and the like, a catch plate 59 that catches a batch of banknotes transported by the paired endless belts 32 and 34 in the rightward direction in FIG. 2 and the like, is provided on the far side (i.e., the right side in FIG. 2 and the like) of the paired endless belts 32 and 34. Since the catch plate 59 is provided, when a batch of banknotes is transported by the paired endless belts 32 and 34 in the rightward direction in FIG. 2 and the like, the batch of banknotes comes into contact with the catch plate 59 and is prevented from being further transported in the rightward direction in FIG. 2 and the like, whereby the batch of banknotes is appropriately delivered to the second transport unit 50 described later. In the first transport unit 30, when a batch of banknotes is inserted into the housing 12 from the outside, the batch of banknotes inserted in the hollow area inside the receptacle 22 through the opening 24 is horizontally transported in the rightward direction in FIG. 2 and the like while being gripped between the paired endless belts 32 and 34. On the other hand, when a batch of banknotes is discharged from the housing 12 to the outside, the batch of banknotes is horizontally transported in the leftward direction in FIG. 2 and the like while being gripped between the paired endless belts 32 and 34, and is sent to the hollow area inside the receptacle 22.

Figure 3:
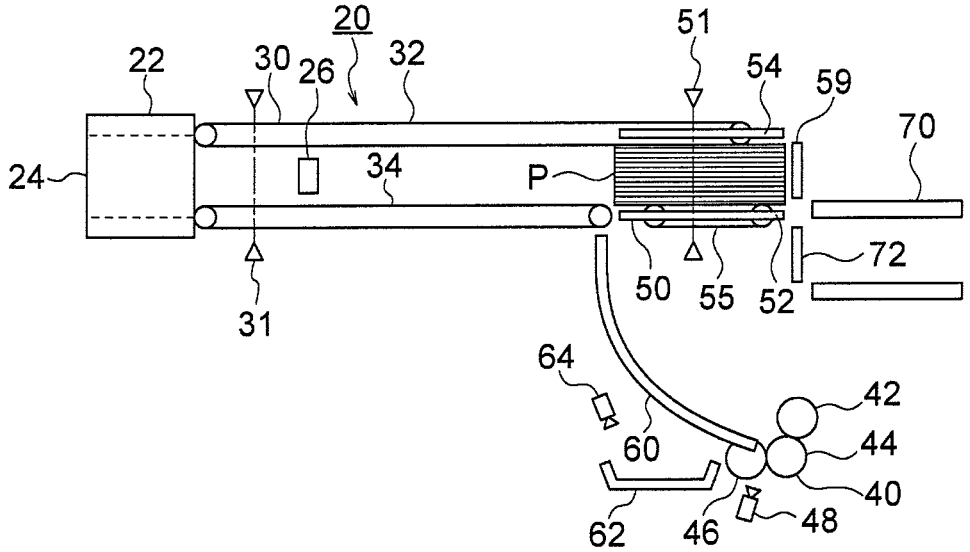
FIG. 3 is a side view illustrating a state where a batch of banknotes inserted into the opening is delivered from a first transport unit to a second transport unit in the banknote insertion/discharge mechanism shown in FIG. 2.

When a batch of banknotes is inserted into the housing 12 from the outside, the batch of banknotes horizontally transported in the rightward direction in FIG. 2 and the like while being gripped between the paired endless belts 32 and 34 in the first transport unit 30 is delivered to the second transport unit 50. As shown in FIG. 2 and the like, the second transport unit 50 has paired plate-shaped gripping members 52 and 54 provided so as to be spaced from each other in the vertical direction, and the batch of banknotes transported by the first transport unit 30 is gripped by the paired gripping members 52 and 54. Each of the paired gripping members 52 and 54 is movable between a first position where the batch of banknotes is delivered from the first transport unit 30 (i.e., the position shown in FIG. 2 or FIG. 3) and a second position where the batch of banknotes is delivered to the feeding unit 40 (i.e., the position shown in FIG. 6). When the paired gripping members 52 and 54 move from the first position to the second position, the batch of banknotes gripped by the paired gripping members 52 and 54 is inclined from the horizontal state as shown in FIG. 2 or FIG. 3 so as to form an angle with respect to the horizontal surface. The upper gripping member 54 is movable in a direction approaching the lower gripping member 52 and in a direction away from the lower gripping member 52.

When the upper gripping member 54 moves in the direction approaching the lower gripping member 52 with a batch of banknotes being present between the upper gripping member 54 and the lower gripping member 52, the batch of banknotes is gripped between the paired gripping members 52 and 54. On the other hand, when the upper gripping member 54 moves in the direction away from the lower gripping member 52 with a batch of banknotes being gripped by the paired gripping members 52 and 54, the batch of banknotes is released from between the paired gripping members 52 and 54.

As shown in FIG. 2 and the like, in the second transport unit 50, the lower gripping member 52 is provided with paired right and left endless belts 55. The endless belts 55 slightly protrude upward with respect to the upper surface of the lower gripping member 52. When a batch of banknotes is gripped by the paired gripping members 52 and 54, the batch of banknotes comes into contact with the endless belts 55. The endless belts 55 can move the batch of banknotes placed on the lower gripping member 52 in the right-left direction in FIG. 2 and the like.

As shown in FIG. 2 and the like, a second detection sensor 51 that detects a batch of banknotes present between the paired gripping members 52 and 54 is provided near the paired gripping members 52 and 54 located at the first position. The second detection sensor 51 is composed of, for example, an optical sensor having a light-emitting element and a light-receiving element that are arranged across the space between the paired gripping members 52 and 54 located at the first position. In the second detection sensor 51, when light emitted from the light-emitting element is not received by the light-receiving element because being blocked by the batch of banknotes gripped between the paired gripping members 52 and 54 located at the first position, the second detection sensor 51 detects that the batch of banknotes is gripped between the paired gripping members 52 and 54 located at the first position.

As shown in FIG. 2 and the like, the second transport unit 50 has a holding member 60 provided so as to extend along a trajectory of left-side end portions of the gripping members 52 and 54 which is formed when the gripping members 52 and 54 move between the first position and the second position described above. As shown in FIG. 2 and the like, the holding member 60 extends in a shape curving from a right-side end portion of the lower endless belt 34 in the first transport unit 30 toward a gate roller 46 (described later) of the feeding unit 40. More specifically, the holding member 60 has a plurality of bar-shaped members extending in parallel to each other. Each bar-shaped member has a shape curving from the right-side end portion of the lower endless belt 34 in the first transport unit 30 toward the gate roller 46 (described later) of the feeding unit 40. Further, spaces (openings) are formed between the respective bar-shaped members, through which a foreign substance such as a coin or a clip dropped from the batch of banknotes transported by the second transport unit 50 passes. Further, as shown in FIG. 2 and the like, beneath the holding member 60, a foreign substance receiving unit 62 is provided which receives a foreign material such as a coin or a clip dropped from the batch of banknotes transported by the second transport unit 50. Further, an imaging unit 64 such as a camera that takes an image of the foreign substance receiving unit 62 is provided near the foreign substance receiving unit 62. When a foreign substance is received by the foreign substance receiving unit 62, it is detected that the foreign substance is received by the foreign substance receiving unit 62, on the basis of the image of the foreign substance receiving unit 62 taken by the imaging unit 64.

According to the present embodiment, in the second transport unit 50, as shown in FIG. 5, a batch of banknotes is inclined by the paired gripping members 52 and 54 so as to form an angle with respect to the horizontal surface, and released from the paired gripping members 52 and 54 when the upper gripping member 54 moves in the direction away from the lower gripping member 52. Then, a lower end portion of the released batch of banknotes is received by the holding member 60. At this time, if a foreign substance such as a coin or a clip is present in the batch of banknotes, such a foreign substance drops from the batch of banknotes, further drops from the holding member 60 through the space between the bar-shaped members of the holding member 60, and is received by the foreign substance receiving unit 62.

Figure 6:
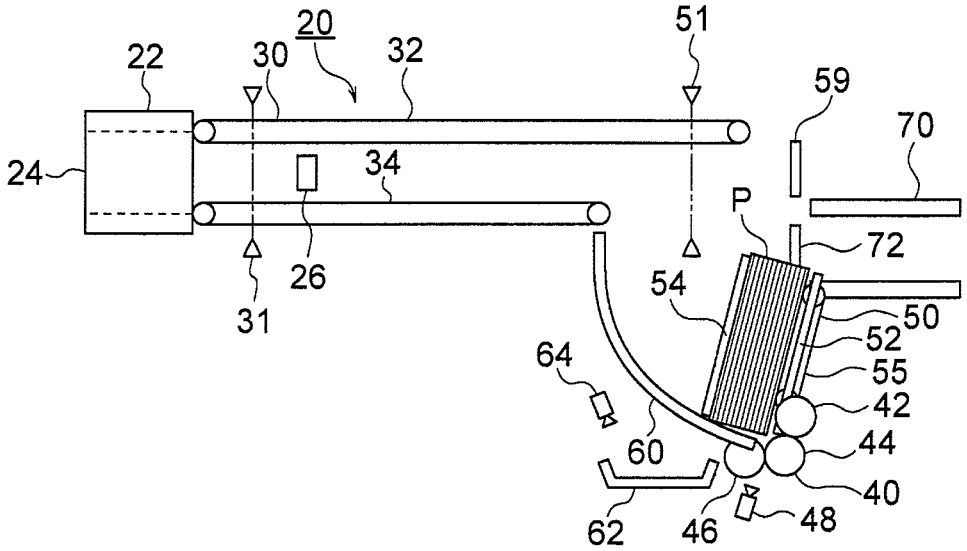
FIG. 6 is a side view illustrating a state where a batch of banknotes is delivered to a feeding unit by the second transport unit in the banknote insertion/discharge mechanism shown in FIG. 2.

As shown in FIG. 2 and the like, the feeding unit 40 has: a kicker roller 42 for kicking banknotes downward one by one from a batch of banknotes delivered from the second transport unit 50 to the feeding unit 40 at the second position as shown in FIG. 6; a feed roller 44 for feeding the banknotes kicked downward by the kicker roller 42 into the housing 12; and the gate roller 46, provided facing the feed roller 44, for separating the banknotes one by one passing between the gate roller 46 and the feed roller 44. In the feeding unit 40, the banknotes kicked downward by the kicker roller 42 are separated one by one when passing through the gap between the feed roller 44 and the gate roller 46, and the banknotes having passed through the gap between the feed roller 44 and the gate roller 46 are sent to the transport unit 80. Further, as shown in FIG. 2 and the like, beneath the feed roller 44 and the gate roller 46, an imaging unit 48 such as a camera is provided which takes an image of the batch of banknotes delivered from the second transport unit 50 to the feeding unit 40. If a foreign substance such as a coin or a clip is present in the batch of banknotes delivered to the feeding unit 40, such a foreign substance is detected on the basis of an image taken by the imaging unit 48. If a foreign substance is detected by the imaging unit 48, the banknote feeding operation into the housing 12 by the feeding unit 40 is stopped. In this case, a warning message is displayed on a display unit (not shown) provided at the front surface or the top surface of the housing 12 of the banknote handling machine 10, or a warning announce is made by an audio unit (not shown).

Figure 7:
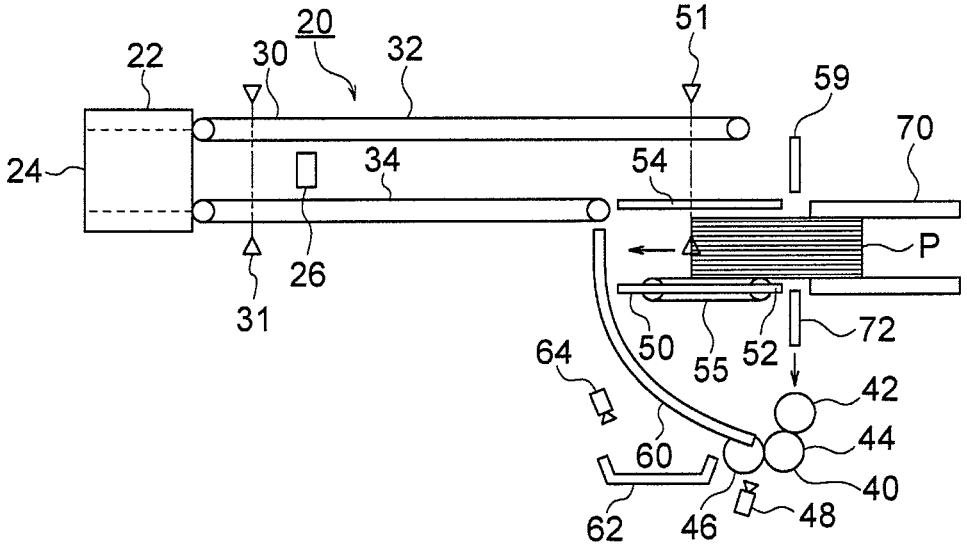
FIG. 7 is a side view illustrating a state where a batch of banknotes is being delivered from a dispensing temporary storage unit to the second transport unit in the banknote insertion/discharge mechanism shown in FIG. 2.

The dispensing temporary storage unit 70, in which banknotes-to-be-dispensed, transported from the transport unit 80, are stacked, is provided on the far side of the banknote insertion/discharge mechanism 20 in the depth direction of the housing 12 (i.e., on the right of the second transport unit 50 in FIG. 2 and the like). The dispensing temporary storage unit 70 is provided with a shutter 72 movable in the up-down direction in FIG. 2 and the like. While the banknotes are being transported from the transport unit 80 to the dispensing temporary storage unit 70 and stacked in the dispensing temporary storage unit 70, a left-side opening of the dispensing temporary storage unit 70 (i.e., an opening on the second transport unit 50 side) is closed by the shutter 72. When all the banknotes to be dispensed are stacked in the dispensing temporary storage unit 70, the shutter 72 moves downward as shown in FIG. 7, whereby the left-side opening of the dispensing temporary storage unit 70 is opened. Then, the batch of banknotes stacked in the dispensing temporary storage unit 70 is sent to the second transport unit 50 so as to be gripped by the paired gripping members 52 and 54 of the second transport unit 50.

Next, an operation for inserting a batch of banknotes into the housing 12 from the outside and an operation for discharging a batch of banknotes from the housing 12 to the outside by using the banknote insertion/discharge mechanism 20 configured as described above will be described with reference to FIG. 2 to FIG. 7.

In a case where banknote depositing is performed in the banknote handling machine 10, when an operator inserts a batch of banknotes in the hollow area inside the receptacle 22 through the opening 24 as shown in FIG. 2, the batch of banknotes inserted in the hollow area inside the receptacle 22 is detected by the first detection sensor 31, and the detection of the batch of banknotes by the first detection sensor 31 triggers driving of the endless belts 32 and 34 in the first transport unit 30. Specifically, the upper endless belt 32 moves toward the lower endless belt 34, whereby the batch of banknotes is gripped between the paired endless belts 32 and 34, and thereafter, the upper endless belt 32 circulates in the counterclockwise direction in FIG. 2, while the lower endless belt 34 circulates in the clockwise direction in FIG. 2 at the same speed as the upper endless belt 32. When the endless belts 32 and 34 are driven, the batch of banknotes is horizontally transported in the rightward direction in FIG. 2 and the like while being gripped between the paired endless belts 32 and 34. When the batch of banknotes transported by the paired endless belts 32 and 34 comes into contact with the catch plate 59, the batch of banknotes is prevented from being further transported in the rightward direction in FIG. 2 and the like, and therefore is appropriately delivered to the second transport unit 50 (refer to FIG. 3).

When the batch of banknotes has been delivered from the first transport unit 30 to the second transport unit 50, the lower gripping member 52 moves downward and the upper gripping member 54 also moves downward accordingly. At this time, the batch of banknotes is not gripped by the paired gripping members 52 and 54. When the paired gripping members 52 and 54 have reached the position shown in FIG. 4, the upper gripping member 54 moves in the direction approaching the lower gripping member 52, whereby the batch of banknotes is gripped between the paired gripping members 52 and 54. Thereafter, the paired gripping members 52 and 54, having the batch of banknotes being gripped therebetween, pivotally move about a predetermined axial center along the holding member 60 to reach the inclined position as shown in FIG. 5. At this time, the batch of banknotes gripped by the paired gripping members 52 and 54 is also inclined from the horizontal state so as to form an angle with respect to the horizontal surface. Thereafter, the upper gripping member 54 moves in the direction away from the lower gripping member 52, whereby the batch of banknotes is released from between the paired gripping members 52 and 54. If a foreign substance such as a coin or a clip is present in the batch of banknotes inclined from the horizontal state so as to form an angle with respect to the horizontal surface, such a foreign substance drops from the inclined batch of banknotes, further drops from the holding member 60 through the space between the bar-shaped members of the holding member 60, and is received by the foreign substance receiving unit 62. The imaging unit 64 takes an image of the foreign substance received by the foreign substance receiving unit 62, whereby it is detected that the foreign substance is received by the foreign substance receiving unit 62.

After the paired gripping members 52 and 54 have reached the inclined position as shown in FIG. 5 and the batch of banknotes has been released from between the paired gripping members 52 and 54, the paired gripping members 52 and 54 reciprocate. Specifically, the paired gripping members 52 and 54 swing in a two-headed arrow direction shown in FIG. 5 about the aforementioned predetermined axial center along the holding member 60. Therefore, if a foreign substance such as a coin or a clip is present in the batch of banknotes between the paired gripping members 52 and 54, such a foreign substance surely drops from the swung batch of banknotes and is received by the foreign substance receiving unit 62. Thus, the foreign substance can be removed from the batch of banknotes more reliably.

After the batch of banknotes inclined so as to form an angle with respect to the horizontal surface as shown in FIG. 5 has been released from the paired gripping members 52 and 54, when a foreign substance is removed from the batch of banknotes by reciprocating motion or the like of the paired gripping members 52 and 54, the batch of banknotes is again gripped by the paired gripping members 52 and 54. Then, the paired gripping members 52 and 54, having the batch of banknotes being gripped therebetween, pivotally moves from the position shown in FIG. 5 to the position shown in FIG. 6 about the aforementioned predetermined axial center. When the paired gripping members 52 and 54 have reached the position shown in FIG. 6, the upper gripping member 54 moves in the direction away from the lower gripping member 52, whereby the batch of banknotes is released from the gripping members 52 and 54 and is delivered from the second transport unit 50 to the feeding unit 40. Thereafter, in the feeding unit 40, the banknotes are kicked downward one by one from the batch of banknotes by the kicker roller 42, and the banknotes kicked downward by the kicker roller 42 are separated one by one when passing through the gap between the feed roller 44 and the gate roller 46. Then, the banknotes having passed through the gap between the feed roller 44 and the gate roller 46 are sent to the transport unit 80, and are transported in the housing 12 by the transport unit 80. In the present embodiment, after the batch of banknotes has been delivered from the second transport unit 50 to the feeding unit 40, when the banknotes are kicked downward one by one from the batch of banknotes by the kicker roller 42 in the feeding unit 40, the batch of banknotes is pressed toward the kicker roller 42 by the upper gripping member 54 in the second transport unit 50. Thus, the banknote kicking operation by the kicker roller 42 can be performed more reliably.

Next, an operation for discharging a batch of banknotes from the housing 12 to the outside by the banknote insertion/discharge mechanism 20 will be described with reference to FIG. 7.

When banknote dispensing is performed in the banknote handling machine 10, banknotes fed from the respective banknote storages 92 to the transport unit 80 are recognized by the recognition unit 82 and thereafter stacked in a layered state in the dispensing temporary storage unit 70. While the banknotes are being transported from the transport unit 80 to the dispensing temporary storage unit 70 and stacked in the dispensing temporary storage unit 70, the left-side opening of the dispensing temporary storage unit 70 in FIG. 2 and the like (i.e., the opening on the second transport unit 50 side) is closed by the shutter 72. When all the banknotes to be dispensed are stacked in the dispensing temporary storage unit 70, the shutter 72 moves downward and the left-side opening of the dispensing temporary storage unit 70 is opened as shown in FIG. 7, whereby the batch of banknotes stacked in the dispensing temporary storage unit 70 is sent to the second transport unit 50 and can be gripped by the paired gripping members 52 and 54 in the second transport unit 50. When the batch of banknotes delivered from the dispensing temporary storage unit 70 to the second transport unit 50 is gripped by the paired gripping members 52 and 54, the gripping members 52 and 54 pivotally move about a predetermined axial center along the holding member 60, to reach the inclined position as shown in FIG. 5. At this time, the batch of banknotes gripped by the paired gripping members 52 and 54 is also inclined from the horizontal state so as to form an angle with respect to the horizontal surface. Thereafter, when the upper gripping member 54 moves in the direction away from the lower gripping member 52, the batch of banknotes are released from between the paired gripping members 52 and 54. Thus, the batch of banknotes is held by the holding member 60 while being inclined so as to form an angle with respect to the horizontal surface, whereby the position of an end portion (i.e., an end portion on the lower left side in FIG. 5) of the batch of banknotes can be aligned by the holding member 60.

After the paired gripping members 52 and 54 have reached the inclined position as shown in FIG. 5 and the batch of banknotes has been released from between the paired gripping members 52 and 54, the paired gripping members 52 and 54 reciprocate. Specifically, the paired gripping members 52 and 54 swing in the two-headed arrow direction shown in FIG. 5 about a predetermined axial center along the holding member 60. Thus, the batch of banknotes present between the paired gripping members 52 and 54 also reciprocates along the holding member 60, whereby the position of the end portion of the batch of banknotes can be aligned more reliably by the holding member 60. Thereafter, the batch of banknotes is gripped by the paired gripping members 52 and 54, and the paired gripping members 52 and 54, having the batch of banknotes being gripped therebetween, move to the position shown in FIG. 4, and further move upward from the position shown in FIG. 4 to be located on the right (i.e., the first position) of the first transport unit 30 as shown in FIG. 3. When the paired gripping members 52 and 54 have reached the first position, the second detection sensor 51 detects that the batch of banknotes is gripped between the paired gripping members 52 and 54 located at the first position. Then, with the detection of the batch of banknotes by the second detection sensor 51 as a trigger, the endless belt 55 attached to the lower gripping member 52 and the lower endless belt 34 of the first transport unit 30 circulate in the counterclockwise direction in FIG. 3, and the upper endless belt 32 of the first transport unit 30 circulates in the clockwise direction in FIG. 3. Thus, the batch of banknotes is delivered from the second transport unit 50 to the first transport unit 30, and is transported in the leftward direction in FIG. 3 by the first transport unit 30 to be sent to the receptacle 22. When the batch of banknotes has been sent to the receptacle 22 as shown in FIG. 1, an operator can take out the batch of banknotes from the housing 12 through the opening 24.

Figure 8A:
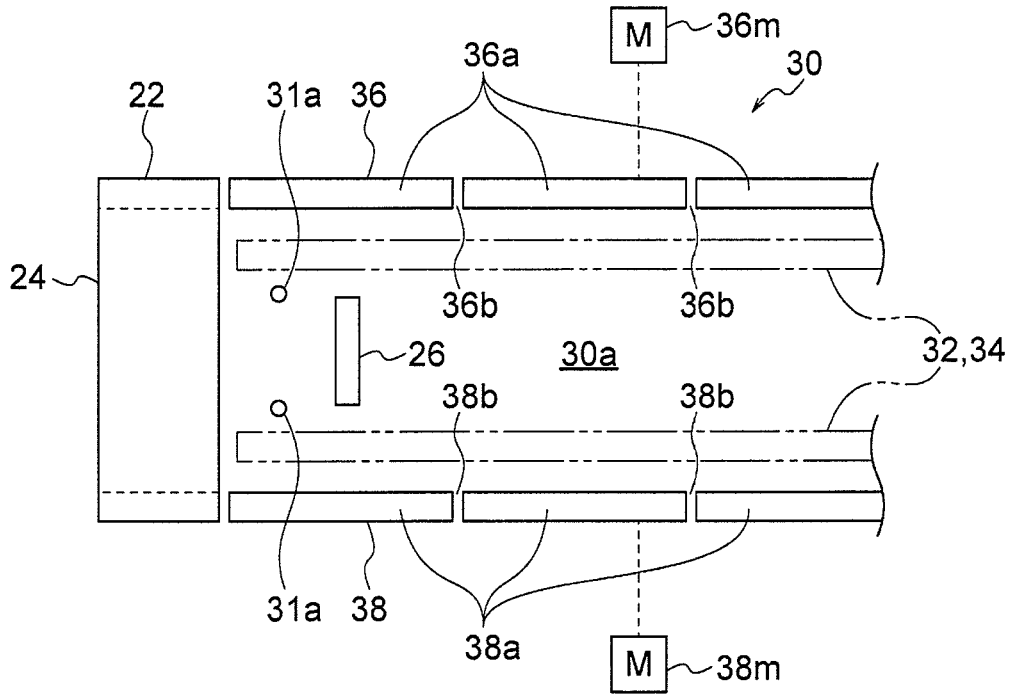
FIG. 8A is a top view illustrating structures of an receptacle and a first transport unit in the banknote insertion/discharge mechanism shown in FIG. 2.
Figure 8B:
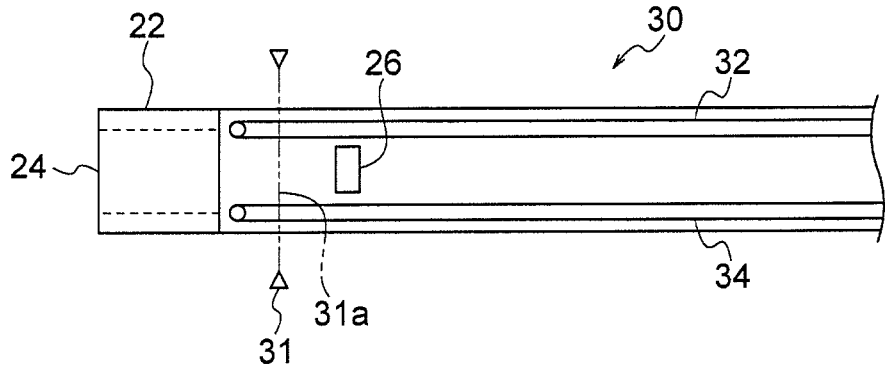
FIG. 8B is a side view illustrating the structures of the receptacle and the first transport unit in the banknote insertion/discharge mechanism shown in FIG. 2.
Figure 9A:
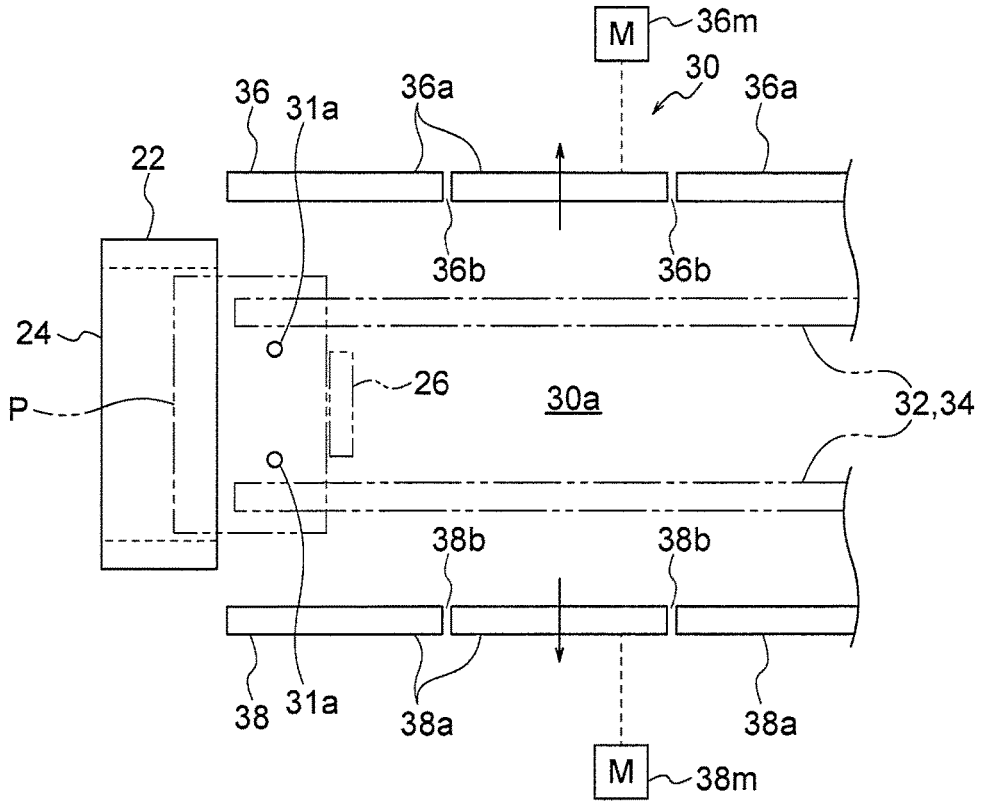
FIG. 9A is a top view illustrating a state where a batch of banknotes is inserted in the receptacle in the banknote insertion/discharge mechanism shown in FIG. 2.
Figure 9B:
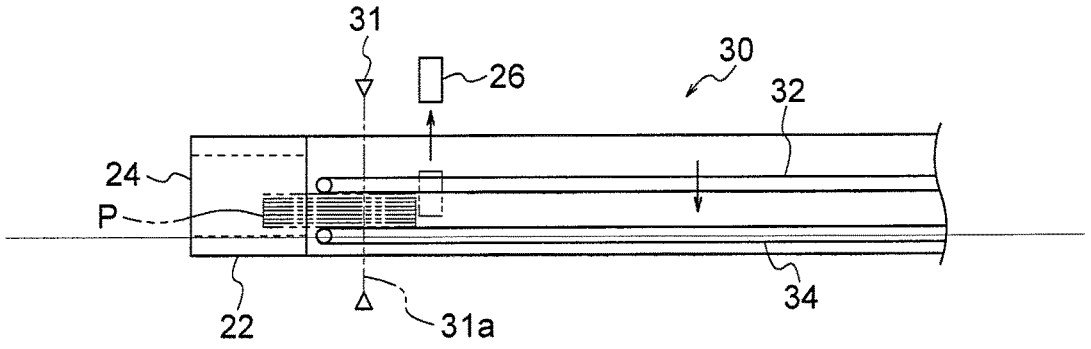
FIG. 9B is a side view illustrating a state where a batch of banknotes is inserted in the receptacle in the banknote insertion/discharge mechanism shown in FIG. 2.
Figure 10A:
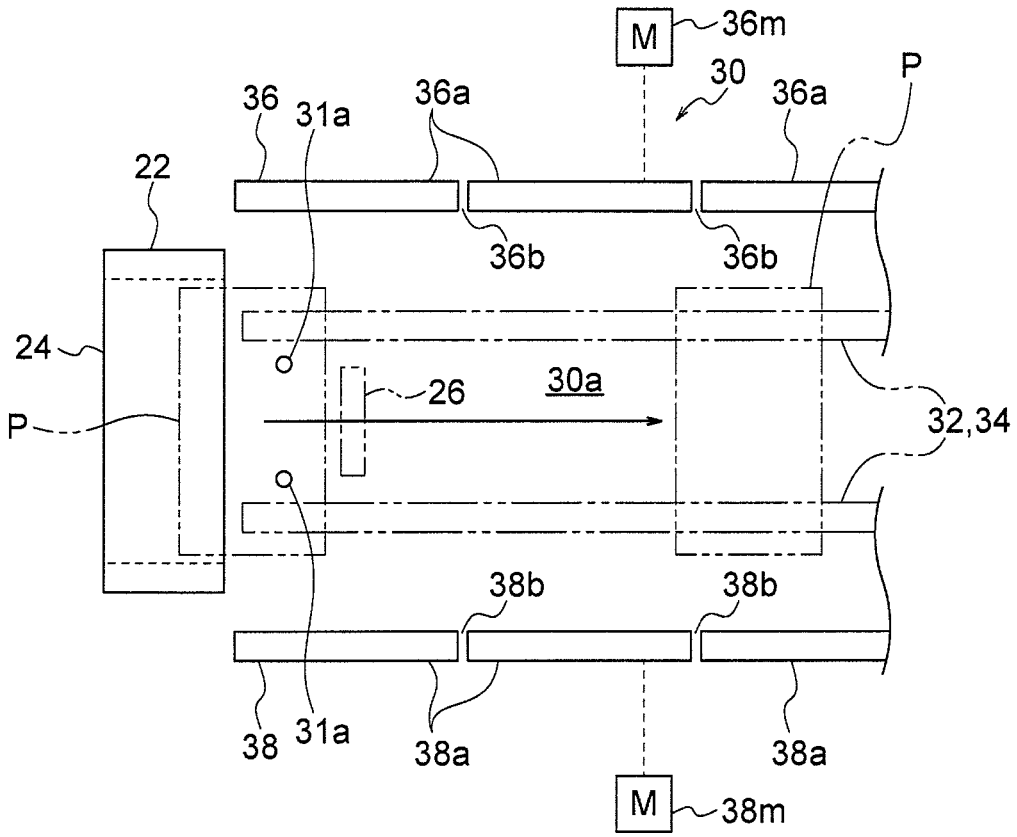
FIG. 10A is a top view illustrating a state where a batch of banknotes inserted in the receptacle is transported by the first transport unit, in the banknote insertion/discharge mechanism shown in FIG. 2.
Figure 10B:
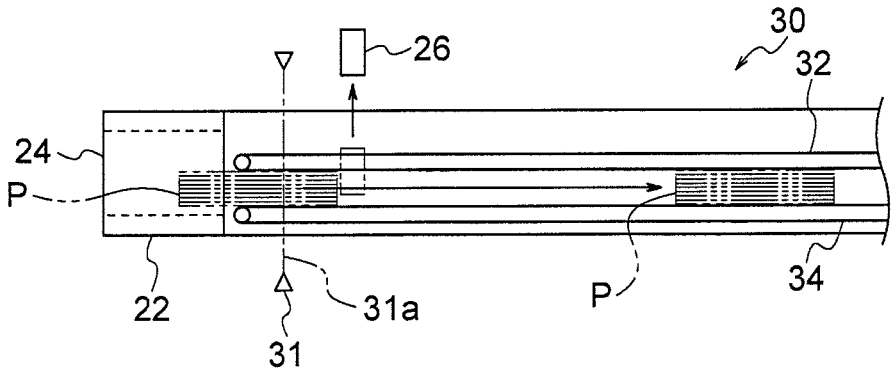
FIG. 10B is a side view illustrating a state where a batch of banknotes inserted in the receptacle is transported by the first transport unit, in the banknote insertion/discharge mechanism shown in FIG. 2.

In the present embodiment, when the aforementioned banknote depositing or dispensing is performed, at least portions of guiding members forming side walls at both edges of the transport path of the first transport unit 30 or the second transport unit 50 are moved along the width direction of the transport path. The guiding members guide the batch of banknotes along the guiding members in the transport path when the first transport unit 30 or the second transport unit 50 transports the batch of banknotes. The width direction of the transport path is identical to the direction orthogonal to the transport direction of the transport path of the first transport unit 30 or the second transport unit 50. The transport path is defined as a path through which the batch of banknotes passes between guiding members 36, 38 (described later) arranged at the edges. Specifically, for example, when a batch of banknotes is transported by the first transport unit 30 in the rightward direction in FIG. 2 and the like, at least portions of a pair of the guiding members 36 and 38 of the first transport unit 30 are moved in directions away from each other so as to increase the width of the transport path. The width of the transport path is namely identified by the distance between the paired guiding members 36, 38 and changeable because the paired guiding members 36, 38 are movable. This operation will be described with reference to FIG. 8A to FIG. 10B. FIG. 8A and FIG. 8B are a top view and a side view, respectively, each illustrating the structures of the receptacle 22 and the first transport unit 30 in the banknote insertion/discharge mechanism 20 shown in FIG. 2 and the like. FIG. 9A and FIG. 9B are a top view and a side view, respectively, each illustrating a state where a batch of banknotes is inserted in the receptacle 22 in the banknote insertion/discharge mechanism 20 shown in FIG. 2 and the like. FIG. 10A and FIG. 10B are a top view and a side view, respectively, each illustrating a state where the batch of banknotes inserted in the receptacle 22 in the banknote insertion/discharge mechanism 20 shown in FIG. 2 and the like is transported by the first transport unit 30. In FIG. 8A to FIG. 10B, an optical axis between the light-emitting element and the light-receiving element of the first detection sensor 31 is represented by a reference character 31*a*.

As shown in FIG. 8A, the first transport unit 30 has the paired guiding members 36 and 38 forming both edges of a first transport path 30*a* through which a batch of banknotes transported by the paired endless belts 32 and 34 passes. The guiding member 36 is divided into a plurality of plate-shaped portions 36*a*, and the guiding member 38 is divided into a plurality of plate-shaped portions 38*a*. Joint portions 36*b* are formed between the plate-shaped portions 36*a*, and joint portions 38*b* are formed between the plate-shaped portions 38*a*. In the first transport unit 30, when a batch of banknotes is transported by the paired endless belts 32 and 34, a corner portion or an edge portion of the batch of banknotes can be caught by the joint portions 36*b* and 38*b*, which may cause abnormal transportation. In the present embodiment, however, when a batch of banknotes is transported by the first transport unit 30 in the rightward direction in FIG. 2 and the like, at least portions of the paired guiding members 36 and 38 are moved in directions away from each other so as to increase the width of the first transport path 30*a*, thereby inhibiting occurrence of such abnormal transportation.

More specifically, as shown in FIG. 8A, FIG. 8B, and the like, the first transport unit 30 is provided with: a driving unit 36*m* that moves the guiding member 36 along the width direction of the first transport path 30*a* (i.e., the up-and-down direction in FIG. 8A); and a driving unit 38*m* that moves the guiding member 38 along the width direction of the first transport path 30*a*. For example, a linear motion guide which is useful for a linear movement mechanism is used as each of the driving units 36*m* and 38*m*. However, the driving unit 36*m*, 38*m* is not limited to the linear motion guide, and any means may be adopted as long as the means can move the guiding member 36, 38 along the width direction of the first transport path 30*a*, respectively. The driving unit 36*m* may integrally move the plurality of plate-shaped portions 36*a* forming the guiding member 36. Alternatively, each of the plate-shaped portions 36*a* forming the guiding member 36 may be moved independently from other plate-shaped portions 36*a*. Likewise, the driving unit 38*m* may integrally move the plurality of plate-shaped portions 38*a* forming the guiding member 38. Alternatively, each of the plate-shaped portions 38*a* forming the guiding member 38 may be moved independently from other plate-shaped portions 38*a*. In the present embodiment, the driving units 36*m* and 38*m* can move the guiding members 36 and 38, respectively, in directions away from each other and in directions approaching each other along the width direction of the first transport path 30*a*.

Next, motions of the guiding members 36 and 38 when a batch of banknotes is transported by the first transport unit 30 in the rightward direction in FIG. 2 and the like will be described with reference to FIG. 8A to FIG. 10B. As shown in FIG. 8A and FIG. 8B, when banknote depositing, banknote dispensing is not performed in the banknote handling machine 10 and the banknote handling machine 10 is in its stand-by state, the guiding members 36 and 38 are located at positions (i.e., stand-by positions) where the width of the first transport path 30*a* is slightly greater than the width of the hollow area inside the receptacle 22. On the other hand, in a case where banknote depositing is performed in the banknote handling machine 10, when an operator inserts a batch of banknotes in the hollow area inside the receptacle 22 through the opening 24, the batch of banknotes inserted in the hollow area inside the receptacle 22 is detected by the first detection sensor 31. Then, as shown in FIG. 9B, with the detection of the batch of banknotes by the first detection sensor 31 as a trigger, the upper endless belt 32 moves toward the lower endless belt 34, whereby the batch of banknotes is gripped between the paired endless belts 32 and 34. Further, as shown in FIG. 9A, with the detection of the batch of banknotes by the first detection sensor 31 as a trigger, the driving units 36*m* and 38*m* move the guiding members 36 and 38, respectively, in directions away from each other along the width direction of the first transport path 30*a*. At this time, the driving units 36*m* and 38*m* move the guiding members 36 and 38 by the same movement amount. Thus, the width of the first transport path 30*a* is increased at this time as compared with that of the first transport path 30*a* at the time when the guiding members 36 and 38 are located at the stand-by positions as shown in FIG. 8A.

The present embodiment is not limited to the aspect in which both the guiding members 36 and 38 are moved in directions away from each other along the width direction of the first transport path 30*a* by using, as a trigger, detection of a batch of banknotes by the first detection sensor 31. When a batch of banknotes is detected by the first detection sensor 31, only one of the guiding members (e.g., the guiding member 36) may be moved in a direction away from the other guiding member (e.g., the guiding member 38), while the other guiding member is not moved. Also in this case, the width of the first transport path 30*a* can be increased. As still another example, when a batch of banknotes is detected by the first detection sensor 31, the driving units 36*m* and 38*m* may move the guiding members 36 and 38 by different movement amounts, respectively.

After the batch of banknotes is gripped between the paired endless belts 32 and 34, the endless belts 32 and 34 circulate as shown in FIG. 10A and FIG. 10B, whereby the batch of banknotes is horizontally transported in the rightward direction in FIG. 10A and FIG. 10B while being gripped between the paired endless belts 32 and 34. Since the width of the first transport path 30*a* is increased at this time as compared with that of the first transport path 30*a* at the time when the guiding members 36 and 38 are located at the stand-by positions as shown in FIG. 8A, a corner portion or an edge portion of the batch of banknotes transported by the paired endless belts 32 and 34 is inhibited from being caught by the joint portions 36*b* and 38*b*, thereby inhibiting occurrence of abnormal transportation in the first transport unit 30.

After the batch of banknotes has been delivered from the first transport unit 30 to the second transport unit 50, the driving units 36*m* and 38*m* move the guiding members 36 and 38, respectively, in directions approaching each other along the width direction of the first transport path 30*a*, whereby the guiding members 36 and 38 are returned to the stand-by positions as shown in FIG. 8A. As another example, even after the batch of banknotes has been delivered from the first transport unit 30 to the second transport unit 50, the guiding members 36 and 38 may remain at the positions where the width of the first transport path 30*a* is increased as shown in FIG. 9A or FIG. 10A. In this case, it is possible to omit an operation of moving the guiding members 36 and 38 when depositing of a batch of banknotes in the next transaction is performed.

Figure 11A:
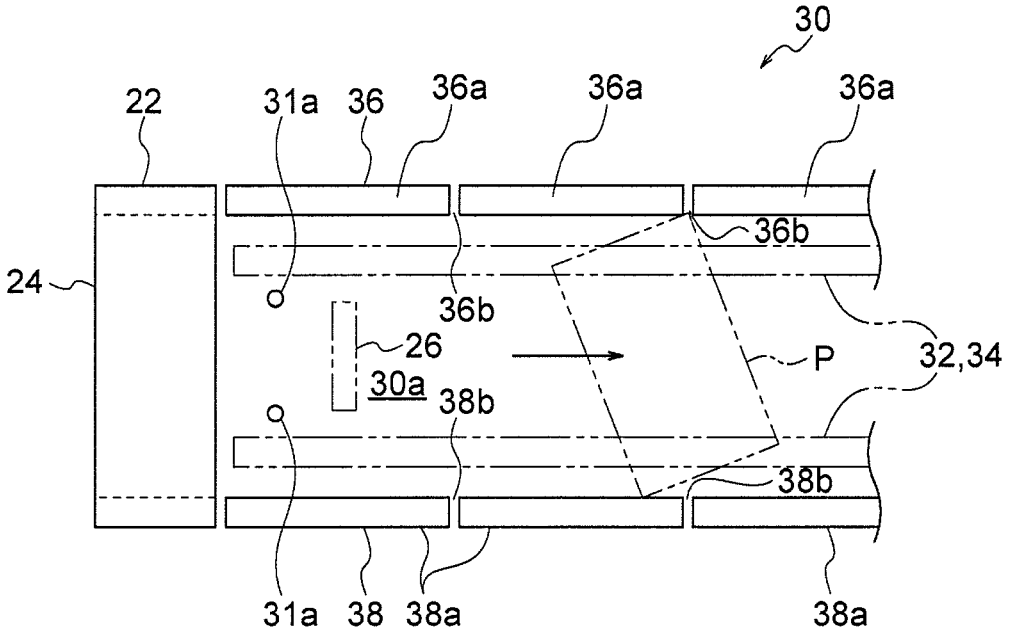
FIG. 11A is a top view illustrating a state where a batch of banknotes inserted in the receptacle is transported by the first transport unit, in a case where the positions of paired guiding members of the first transport unit are fixed and therefore the width of the transport path cannot be increased.
Figure 11B:
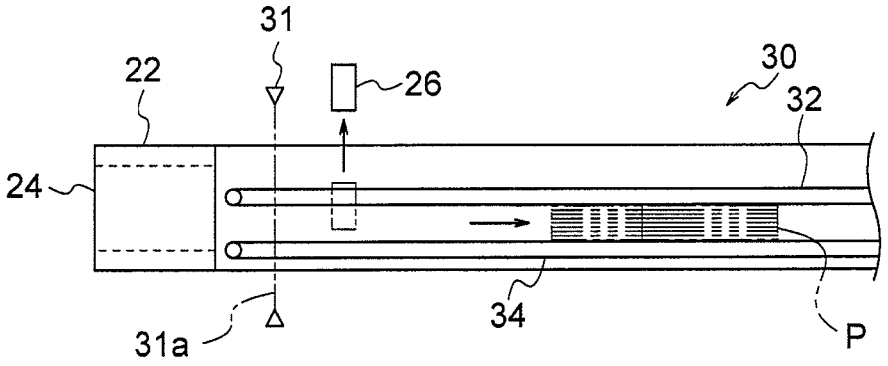
FIG. 11B is a side view illustrating the state where a batch of banknotes inserted in the receptacle is transported by the first transport unit, in the case where the positions of the paired guiding members of the first transport unit are fixed and therefore the width of the transport path cannot be increased.

As a comparative example, a case where the positions of the paired guiding members 36 and 38 are fixed in the first transport unit 30 and the width of the first transport path 30*a* cannot be increased, will be described with reference to FIG. 11A and FIG. 11B. FIG. 11A and FIG. 11B are a top view and a side view, respectively, each illustrating a state where a batch of banknotes inserted in the receptacle 22 is transported by the first transport unit 30 in the aforementioned case. In FIG. 11A and FIG. 11B, an optical axis between the light-emitting element and the light-receiving element of the first detection sensor 31 is represented by a reference character 31*a*. In the case where the width of the first transport path 30*a* cannot be increased, when a batch of banknotes is horizontally transported in the rightward direction in FIG. 11A and FIG. 11B while being gripped between the paired endless belts 32 and 34, a corner portion or an edge portion of the batch of banknotes is caught by the joint portions 36*b* formed between adjacent plate-shaped portions 36*a* of one of the guiding members (e.g., the guiding member 36) as shown in FIG. 11A, and the batch of banknotes is skewed or jammed in the first transport unit 30, which may cause abnormal transportation. In contrast, according to the present embodiment, the driving units 36*m* and 38*m* move at least portions of the guiding members 36 and 38 along the width direction of the first transport path 30*a* such that the width of the first transport path 30*a* in the case where banknotes are transported by the first transport unit 30 is greater than the width of the first transport path 30*a* in the case where banknotes are not transported by the first transport unit 30 (i.e., in the case where the guiding members 36 and 38 are located at the stand-by positions as shown in FIG. 8A and FIG. 8B). Thus, when a batch of banknotes is transported by the first transport unit 30 (specifically, the paired endless belts 32 and 34), a corner portion or an edge portion of the batch of banknotes is inhibited from being caught by the joint portions 36*b* and 38*b*, thereby inhibiting occurrence of abnormal transportation in the first transport unit 30. In particular, according to the present embodiment, the paired endless belts 32 and 34 are far spaced from each other when the banknote handling machine 10 is in the stand-by state, and the upper endless belt 32 moves toward the lower endless belt 34 when a batch of banknotes is inserted in the receptacle 22 and detected by the first detection sensor 31, whereby the batch of banknotes is gripped between the paired endless belts 32 and 34. Therefore, when an operator inserts a batch of banknotes in the receptacle 22 through the opening 24, the position of the batch of banknotes in the width direction of the first transport path 30*a* may deviate from the center position. However, even when the position of the batch of banknotes in the width direction of the first transport path 30*a* deviates from the center position, the batch of banknotes can be inhibited from being caught by the joint portions 36*b* and 38*b* of the guiding members 36 and 38 by moving at least portions of the guiding members 36 and 38 along the width direction of the first transport path 30*a* so as to increase the width of the first transport path 30*a*.

Figure 12:
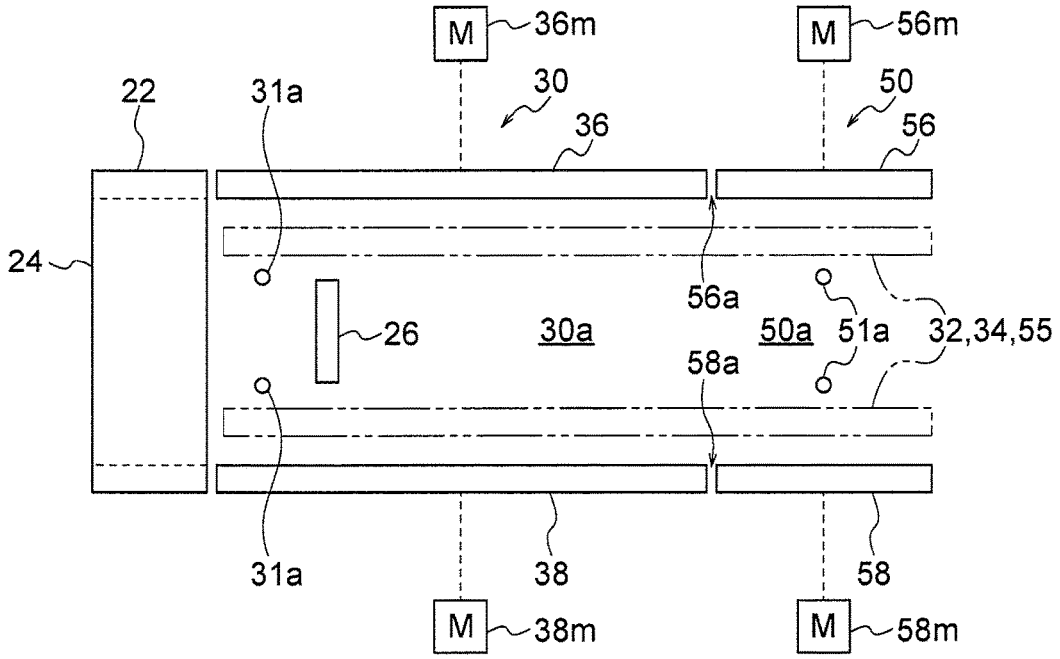
FIG. 12 is a top view illustrating another example of structures of the receptacle, the first transport unit, and the second transport unit in the banknote insertion/discharge mechanism shown in FIG. 2.
Figure 13:
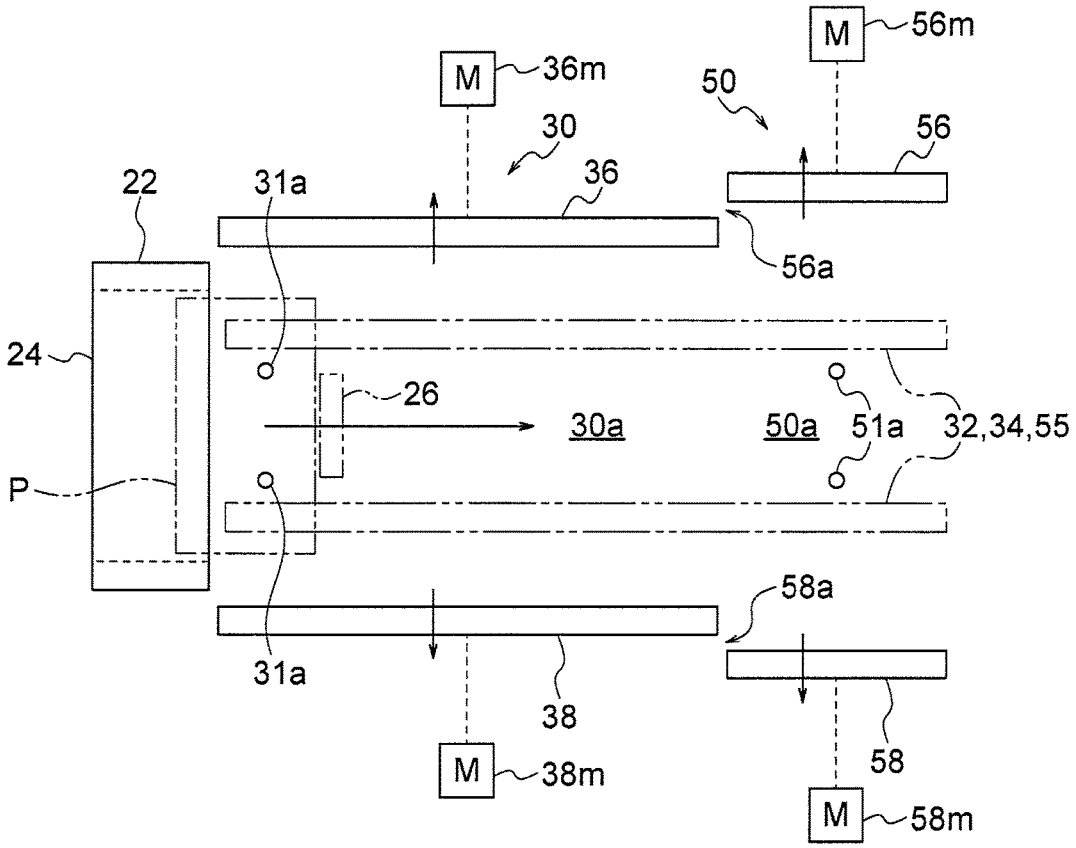
FIG. 13 is a top view illustrating an operation in a case where banknote depositing is performed through the receptacle, the first transport unit, and the second transport unit shown in FIG. 12.

In the banknote handling machine 10 of the present embodiment, when banknote depositing is performed, guiding members 56 and 58 (described later) of the second transport unit 50 may also be moved as well as the guiding members 36 and 38 of the first transport unit 30 when a batch of banknotes inserted in the receptacle 22 is detected by the first detection sensor 31. Such an aspect will be described with reference to FIG. 12 and FIG. 13. FIG. 12 is a top view illustrating another example of structures of the receptacle 22, the first transport unit 30, and the second transport unit 50 in the banknote insertion/discharge mechanism 20 shown in FIG. 2 and the like. FIG. 13 is a top view illustrating an operation in a case where banknote depositing is performed through the receptacle 22, the first transport unit 30, and the second transport unit 50 shown in FIG. 12. In FIG. 11A, FIG. 11B, FIG. 12, and later-described FIG. 13, an optical axis between the light-emitting element and the light-receiving element of the first detection sensor 31 is represented by a reference character 31*a*, and an optical axis between the light-emitting element and the light-receiving element in the second detection sensor 51 is represented by a reference character 51*a*.

As shown in FIG. 12, the second transport unit 50 has a second transport path 50*a* through which a batch of banknotes transported between the endless belts 32 and 55 passes. The second transport path 50 has the paired guiding members 56 and 58 forming both edges of the second transport path 50*a*. In the banknote insertion/discharge mechanism 20 having the first transport unit 30 and the second transport unit 50, when a batch of banknotes is transported between the paired endless belts 32 and 34 or between the paired endless belts 32 and 55, a corner portion or an edge portion of the batch of banknotes is caught by a joint portion 56*a* formed between the guiding member 36 and the guiding member 56 or a joint portion 58*a* formed between the guiding member 38 and the guiding member 58, which may cause abnormal transportation. In the present embodiment, however, when the batch of banknotes is transported by the first transport unit 30 in the rightward direction in FIG. 2 and the like and is delivered from the first transport unit 30 to the second transport unit 50, at least portions of the paired guiding members 36 and 38 are moved in directions away from each other and at least portions of the paired guiding members 56 and 58 are moved in directions away from each other such that the widths of the first transport path 30*a* and the second transport path 50*a* are increased, and moreover, the width of the second transport path 50*a* is greater than the width of the first transport path 30*a*, thereby inhibiting occurrence of abnormal transportation.

More specifically, as shown in FIG. 12 and the like, the second transport unit 50 is provided with: a driving unit 56*m* that moves the guiding member 56 along the width direction of the second transport path 50*a* (i.e., the up-down direction in FIG. 12 and the like); and a driving unit 58*m* that moves the guiding member 58 along the width direction of the second transport path 50*a*. For example, the linear motion guide is used as each of the driving units 56*m* and 58*m*. However, the driving unit 56*m*, 58*m* is not limited to the linear motion guide, and any means may be adopted as long as the means can move the guiding member 56, 58 along the width direction of the second transport path 50*a*, respectively. The driving units 56*m* and 58*m* can move the guiding members 56 and 58, respectively, in directions away from each other and in directions approaching each other along the width direction of the second transport path 50*a*.

Next, FIG. 12 and FIG. 13 illustrate motions of the guiding members 36 and 38 and the guiding members 56 and 58 when a batch of banknotes is transported by the first transport unit 30 in the rightward direction shown in FIG. 12 and the like and delivered from the first transport unit 30 to the second transport unit 50. As shown in FIG. 12, when banknote depositing or banknote dispensing is not performed in the banknote handling machine 10 and the banknote handling machine 10 is in its stand-by state, the guiding members 36 and 38 are located at positions (i.e., stand-by positions) where the width of the first transport path 30*a* is slightly greater than the width of the hollow area inside the receptacle 22. In this case, the guiding members 56 and 58 are also located at positions (i.e., stand-by positions) where the width of the second transport path 50*a* is slightly greater than the width of the hollow area inside the receptacle 22. On the other hand, in a case where banknote depositing is performed in the banknote handling machine 10, when an operator inserts a batch of banknotes in the hollow area inside the receptacle 22 through the opening 24, the batch of banknotes inserted in the hollow area inside the receptacle 22 is detected by the first detection sensor 31. Then, with the detection of the batch of banknotes by the first detection sensor 31 as a trigger, the driving units 36*m* and 38*m* move the guiding members 36 and 38, respectively, in directions away from each other along the width direction of the first transport path 30*a*. With the detection of the batch of banknotes by the first detection sensor 31 as a trigger, the driving units 56*m* and 58*m* also move the guiding members 56 and 58, respectively, in directions away from each other along the width direction of the second transport path 50*a*. The driving units 56*m* and 58*m* move the guiding members 56 and 58 such that the movement amount of the guiding members 56 and 58 is greater than the movement amount of the guiding members 36 and 38. Thus, the widths of the first transport path 30*a* and the second transport path 50*a* are increased as compared with those in the case where the guiding members 36 and 38 are located at the stand-by positions as shown in FIG. 12, and moreover, the width of the second transport path 50*a* is greater than the width of the first transport path 30*a*.

The present embodiment is not limited to the aspect in which both the guiding members 56 and 58 are moved in directions away from each other along the width direction of the second transport path 50*a* by using, as a trigger, detection of a batch of banknotes by the first detection sensor 31. When a batch of banknotes is detected by the first detection sensor 31, only one of the guiding members (e.g., the guiding member 56) may be moved in a direction away from the other guiding member (e.g., the guiding member 58), while the other guiding member is not moved. Also in this case, the width of the second transport path 50*a* can be increased. As still another example, when a batch of banknotes is detected by the first detection sensor 31, the driving units 56*m* and 58*m* may move the guiding members 56 and 58 by the same movement amount, or may move the guiding members 56 and 58 by different movement amounts.

After the batch of banknotes is gripped between the paired endless belts 32 and 34, the endless belts 32 and 34 circulate, whereby the batch of banknotes is horizontally transported in the rightward direction in FIG. 13 while being gripped between the paired endless belts 32 and 34. At this time, the widths of the first transport path 30*a* and the second transport path 50*a* are increased as compared with those in the case where the guiding members 36 and 38 and the guiding members 56 and 58 are located at the stand-by positions as shown in FIG. 12. Therefore, when the batch of banknotes is transported by the paired endless belts 32 and 34, a corner portion or an edge portion of the batch of banknotes is inhibited from being caught by the joint portions (e.g., the joint portions 36*b* and 38*b*) formed in the guiding members 36 and 38 and the guiding members 56 and 58. Moreover, the width of the second transport path 50*a* is greater than the width of the first transport path 30*a*. Therefore, when the batch of banknotes is delivered from the first transport unit 30 to the second transport unit 50, a corner portion or an edge portion of the batch of banknotes is inhibited from being caught by the joint portions 56*a* and 58*a* formed between the guiding members 36 and 56 and between the guiding members 38 and 58, respectively. Thus, occurrence of abnormal transportation is inhibited when the batch of banknotes is delivered from the first transport unit 30 to the second transport unit 50.

In the example shown in FIG. 13, when a batch of banknotes is detected by the first detection sensor 31, the guiding members 36 and 38 are moved in directions away from each other along the width direction of the first transport path 30*a*, and the guiding members 56 and 58 are moved in directions away from each other along the width direction of the second transport path 50*a*. However, the present invention is not limited to such an aspect. As another example, when a batch of banknotes is detected by the first detection sensor 31, the guiding members 36 and 38 in the first transport unit 30 may not be moved whereas the guiding members 56 and 58 in the second transport unit 50 are moved in directions away from each other along the width direction of the second transport path 50*a*. Also in this case, since the width of the second transport path 50*a* is greater than the width of the first transport path 30*a*, when a batch of banknotes is delivered from the first transport unit 30 to the second transport unit 50, a corner portion or an edge portion of the batch of banknotes is inhibited from being caught by the joint portions 56*a* and 58*a* formed between the guiding members 36 and 56 and between the guiding members 38 and 58, respectively.

Figure 14:
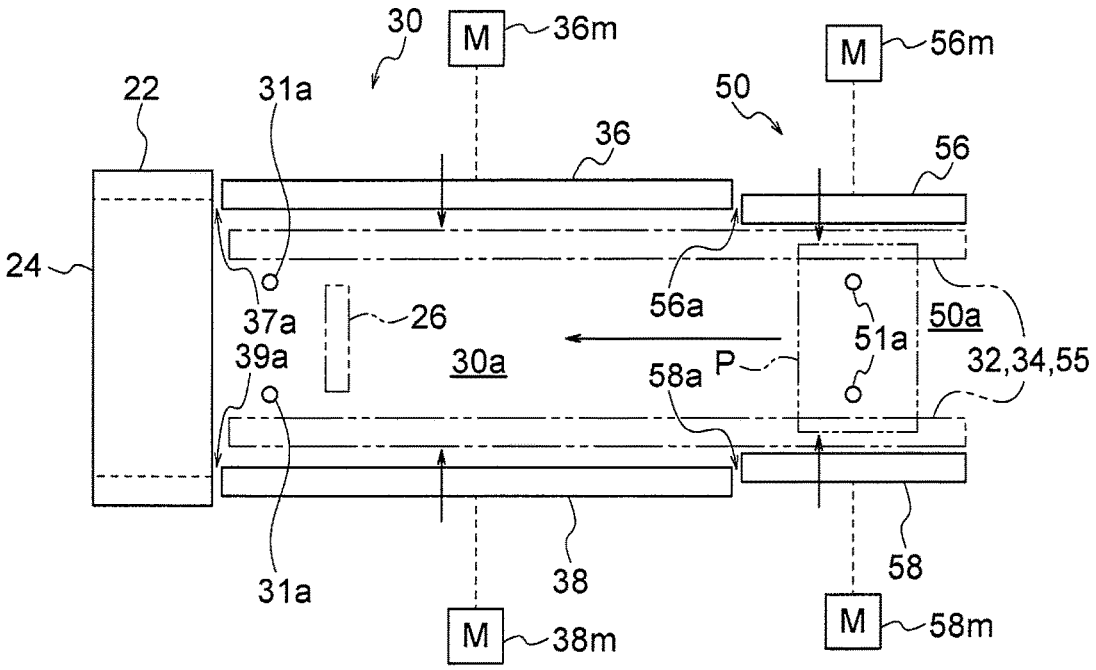
FIG. 14 is a top view illustrating an operation in a case where banknote dispensing is performed through the receptacle, the first transport unit, and the second transport unit shown in FIG. 12.

In the banknote insertion/discharge mechanism 20 in which the guiding members 36 and 38 of the first transport unit 30 are moved along the width direction of the first transport path 30*a* and the guiding members 56 and 58 of the second transport unit 50 are moved along the width direction of the second transport path 50*a*, when a batch of banknotes is discharged from the inside of the housing 12 to the outside, the guiding members 36 and 38 and the guiding members 56 and 58 may be moved such that the width of the first transport path 30*a* and the width of the second transport path 50*a* are reduced. Such an aspect will be described with reference to FIG. 12 and FIG. 14. FIG. 14 is a top view illustrating an operation in a case where banknote dispensing is performed through the receptacle 22, the first transport unit 30, and the second transport unit 50 shown in FIG. 12.

Figure 4:
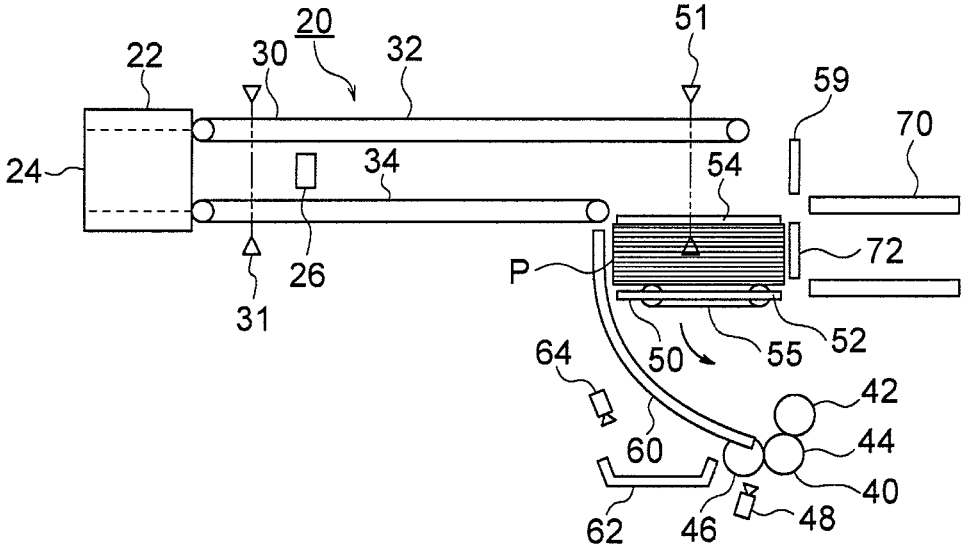
FIG. 4 is a side view illustrating a state where a batch of banknotes is transported by the second transport unit in the banknote insertion/discharge mechanism shown in FIG. 2.

When banknote dispensing is performed, after a batch of banknotes delivered from the dispensing temporary storage unit 70 to the second transport unit 50 is gripped by the paired gripping members 52 and 54, the gripping members 52 and 54 move to the position shown in FIG. 4, and further, the paired gripping members 52 and 54 move upward from the position shown in FIG. 4 to reach the position on the right of the first transport unit 30 (i.e., the first position) as shown in FIG. 3. Then, the second detection sensor 51 detects that the batch of banknotes is gripped between the paired gripping members 52 and 54 located at the first position. Thereafter, as shown in FIG. 14, with the detection of the batch of banknotes by the second detection sensor 51 as a trigger, the driving units 36*m* and 38*m* move the guiding members 36 and 38, respectively, in directions approaching each other along the width direction of the first transport path 30*a*. Further, with the detection of the batch of banknotes by the second detection sensor 51 as a trigger, the driving units 56*m* and 58*m* also move the guiding members 56 and 58, respectively, in directions approaching each other along the width direction of the second transport path 50*a*. The driving units 56*m* and 58*m* move the guiding members 56 and 58 such that the movement amount of the guiding members 56 and 58 is greater than the movement amount of the guiding members 36 and 38. Thus, the widths of the first transport path 30*a* and the second transport path 50*a* are reduced as compared with those in the case where the guiding members 36 and 38 are located at the stand-by positions as shown in FIG. 12, and moreover, the width of the second transport path 50*a* is narrower than the width of the first transport path 30*a*.

The present embodiment is not limited to the aspect in which both the guiding members 56 and 58 are moved in directions approaching each other along the width direction of the second transport path 50*a* by using, as a trigger, detection of a batch of banknotes by the second detection sensor 51. When a batch of banknotes is detected by the second detection sensor 51, only one of the guiding members (e.g., the guiding member 56) may be moved in a direction approaching the other guiding member (e.g., the guiding member 58), while the other guiding member is not moved. Also in this case, the width of the second transport path 50*a* can be reduced. As still another example, when a batch of banknotes is detected by the second detection sensor 51, the driving units 56*m* and 58*m* may move the guiding members 56 and 58 by the same movement amount, or may move the guiding members 56 and 58 by different movement amounts respectively.

After the batch of banknotes is gripped between the paired endless belts 32 and 55, the endless belts 32, 34, and 55 circulate, whereby the batch of banknotes is delivered from the second transport unit 50 to the first transport unit 30. Thereafter, the batch of banknotes is horizontally transported in the leftward direction in FIG. 14 while being gripped between the paired endless belts 32 and 34. At this time, the widths of the first transport path 30*a* and the second transport path 50*a* are reduced as compared with those in the case where the guiding members 36 and 38 and the guiding members 56 and 58 are located at the stand-by positions as shown in FIG. 12, and moreover, the width of the second transport path 50*a* is smaller than the width of the first transport path 30*a*. Thus, when the batch of banknotes is delivered from the second transport unit 50 to the first transport unit 30, a corner portion or an edge portion of the batch of banknotes is inhibited from being caught by the joint portions 56*a* and 58*a* formed between the guiding members 36 and 56 and between the guiding members 38 and 58, respectively. Further, when the batch of banknotes is delivered from the first transport unit 30 to the hollow area inside the receptacle 22, a corner portion or an edge portion of the batch of banknotes is inhibited from being caught by the joint portions 37*a* and 39*a* (refer to FIG. 14) formed between the receptacle 22 and the guiding members 36 and 38, respectively. Thus, when the batch of banknotes is transported from the second transport unit 50 to the receptacle 22, occurrence of abnormal transportation is inhibited.

In the banknote handling machine 10 according to the present embodiment, the upper unit 14 is provided with the shifting unit 86. Therefore, when banknote dispensing is performed, before banknotes to be dispensed are sent to the dispensing temporary storage unit 70, the banknotes to be dispensed can be shifted by the shifting unit 86 to the center position in the width direction of the transport path of the transport unit 80. In this case, when the banknotes are stacked in a layered state in the dispensing temporary storage unit 70, the banknotes are stacked at the center position in the width direction of the dispensing temporary storage unit 70. Therefore, when the batch of banknotes delivered from the dispensing temporary storage unit 70 to the second transport unit 50 is gripped between the paired gripping members 52 and 54, the batch of banknotes is also located at the center position in the width direction of the second transport path 50*a* of the second transport unit 50. Therefore, even when the guiding members 56 and 58 are moved in directions approaching each other along the width direction of the second transport path 50*a* upon detection of the batch of banknotes by the second detection sensor 51, the guiding members 56 and 58 are inhibited from colliding with the batch of banknotes gripped between the paired gripping members 52 and 54.

In the example shown in FIG. 14, when a batch of banknotes is detected by the second detection sensor 51, the guiding members 36 and 38 are moved in directions approaching each other along the width direction of the first transport path 30*a*, and the guiding members 56 and 58 are moved in directions approaching each other along the width direction of the second transport path 50*a*. However, the present invention is not limited to this aspect. As another example, when a batch of banknotes is detected by the second detection sensor 51, the guiding members 36 and 38 of the first transport unit 30 may not be moved whereas the guiding members 56 and 58 of the second transport unit 50 are moved in directions approaching each other along the width direction of the second transport path 50*a*. Also in this case, since the width of the second transport path 50*a* is smaller than the width of the first transport path 30*a*, when a batch of banknotes is delivered from the second transport unit 50 to the first transport unit 30, a corner portion or an edge portion of the batch of banknotes is inhibited from being caught by the joint portions 56*a* and 58*a* formed between the guiding members 36 and 56 and between the guiding members 38 and 58, respectively.

As described above, in the exemplary structure as shown in FIG. 12 to FIG. 14, when a batch of banknotes is transported between the first transport unit 30 and the second transport unit 50, the guiding members of at least one of the upstream transport path and the downstream transport path are moved along the width direction of the transport path such that the width of the downstream transport path is greater than the width of the upstream transport path. When the batch of banknotes is transported from the first transport path 30*a* of the first transport unit 30 to the second transport path 50*a* of the second transport unit 50, the upstream transport path corresponds to the first transport path 30*a* and the downstream path corresponds to the second transport path 50*a*. On the other hand, when the batch of banknotes is transported from the second transport path 50*a* of the first transport unit 50 to the first transport path 30*a* of the first transport unit 30, the upstream transport path corresponds to the second transport path 50*a* and the downstream path corresponds to the first transport path 30*a*. Thus, when the batch of banknotes is delivered from the upstream transport unit to the downstream transport unit, a corner portion or an edge portion of the batch of banknotes is inhibited from being caught by the joint portion formed between the guiding member of the upstream transport unit and the guiding member of the downstream transport unit. Thus, occurrence of abnormal transportation is inhibited when the batch of banknotes is transported from the upstream transport unit toward the downstream transport unit.

The banknote handling machine 10 according to the present embodiment and the banknote handling method using the banknote handling machine 10 are not limited to the structure and the method described above, and various modifications thereto can be made.

For example, a case where the joint portions are formed in the guiding members is described above. However, the present invention is not limited thereto. Even no joint portions are formed in the guiding members abnormal transportation may occur if banknotes are transported being shifted from the center position to the side of the transport path in the width direction of the transport path or being skewed and come into contact with the guiding members. Also in this case, occurrence of abnormal transportation can be inhibited by the guiding members 36 and 38 and the guiding members 56 and 58 performing the same operations as described above.

Further, a case where a batch of banknotes is transported by the first transport unit 30 and the second transport unit 50 is described above. However, even in a case where one banknote is transported by the first transport unit 30 and the second transport unit 50, the guiding members 36 and 38 and the guiding members 56 and 58 may perform the same operations as described above. That is, when one banknote is transported by the first transport unit 30 and the second transport unit 50, the guiding members 36 and 38 and the guiding members 56 and 58 may be moved by the driving units 36*m* and 38*m* and by the driving units 56*m* and 58*m* along the first transport path 30*a* and the second transport path 50*a*, respectively.

In the banknote handling machine 10 according to the present embodiment, setting of the movement amounts of the guiding members 36 and 38 and the guiding members 56 and 58 may be performed. Specifically, an operator may set the movement amounts of the guiding members 36 and 38 and the guiding members 56 and 58 through an operation unit (not shown) such as a touch panel provided on the banknote handling machine 10. Alternatively, the movement amounts of the guiding members 36 and 38 and the guiding members 56 and 58 may be set on the basis of information transmitted from an external apparatus such as a host terminal to the banknote handling machine 10. Further, the movement amounts of the guiding members 36 and 38 and the guiding members 56 and 58 may be adjusted on the basis of the width of each banknote that is specified on the basis of the country of issue, denomination, or the like of the banknote to be handled in the banknote handling machine 10. Further, when abnormal transportation of a batch of banknotes (specifically, skew, jamming, or the like of a batch of banknotes) occurs in the first transport unit 30 or the second transport unit 50, such abnormal transportation may be detected by a transportation state detection sensor (not shown), and the movement amounts of the guiding members 36 and 38 and the guiding members 56 and 58 may be determined on the basis of the result of the detection by the transportation state detection sensor.

Further, sheets handled by the sheet handling machine and the sheet handling method according to the present invention are not limited to banknotes. The sheet handling machine and the sheet handling method according to the present invention may be configured to handle sheets (specifically, checks, gift coupons, etc.) other than banknotes.

What is claimed is:

1. A sheet handling apparatus comprising:

a housing;

a receptacle configured to insert a sheet into the housing;

a transport unit configured to transport the sheet inserted into the housing along a transport direction of a transport path, the transport path including a first transport path and a second transport path connected to the first transport path, the first transport path is disposed upstream of the second transport path to transport the sheet from the first transport path to the second transport path;

a driving unit configured to move at least a portion of a guiding member disposed at an edge of the second transport path along a width direction of the first transport path; and a first sheet detection unit disposed at an inlet of the first transport path, the first sheet detection unit configured to detect the sheet inserted into the housing, wherein when the sheet inserted into the housing is detected by the first sheet detection unit, the portion of the guiding member is moved along the width direction of the second transport path by the driving unit such that the width of the second transport path is greater than the width of the first transport path.

2. The sheet handling apparatus according to claim 1, wherein a pair of the guiding members are disposed at both the edges of the second transport path, and the driving unit is configured to move the guiding members in directions away from each other and in directions approaching each other.

3. The sheet handling apparatus according to claim 2, wherein the driving unit is configured to move the guiding members by the same movement amount.

4. The sheet handling apparatus according to claim 1, wherein the transport unit includes paired belts spaced from each other, and the belts are configured to be moved with sheets in a batch form being gripped therebetween, to transport the sheets in a batch form.

5. The sheet handling apparatus according to claim 1, wherein the driving unit configured to move the portion of the guiding member such that a first width of the second transport path in a case where the sheet inserted into the housing is transported by the transport unit is greater than a second width of the second transport path in a case where the sheet inserted into the housing is not transported by the transport unit.

6. The sheet handling apparatus according to claim 1, wherein when the sheet inserted into the housing is detected by the first sheet detection unit, transportation of the sheet by the transport unit is started.

7. The sheet handling apparatus according to claim 2, wherein the sheet being transported by the transport unit passes through the transport path between the both guiding members.

8. The sheet handling apparatus according to claim 2, wherein the transport unit includes a pair of gripping parts spaced from each other;

the receptacle is configured to insert a batch of sheets into the housing; and the pair of guiding members provided at both sides of the gripping parts are configured to move in a direction perpendicular to a gripping direction of the gripping parts, wherein the transport unit is configured to transport the batch of sheets inserted into the housing by gripping the batch of sheets by the gripping parts.

9. The sheet handling apparatus according to claim 8, further comprising a feeding unit configured to feed the batch of sheets transported by the transport unit one by one.

10. The sheet handling apparatus according to claim 8, wherein the driving unit is configured to move the guiding members such that the first width of the transport path in a case where the gripping parts grip the batch of the sheets inserted into the housing is greater than a second width of the transport path in a case where the gripping parts do not grip the batch of sheets inserted into the housing.

11. The sheet handling apparatus according to claim 8, wherein the gripping parts include a pair of belts.

12. The sheet handling apparatus according to claim 9, wherein the gripping parts include a pair of belts.

* * * * *